US011241350B2

(12) United States Patent
Kaikenger et al.

(10) Patent No.: US 11,241,350 B2
(45) Date of Patent: Feb. 8, 2022

(54) PATIENT TURNING SYSTEM

(71) Applicant: Hill-Rom Services, Inc., Batesville, IN (US)

(72) Inventors: Philippe Kaikenger, Pluvigner (FR); Jean-Bernard Duvert, Auray (FR); Thierry Flocard, Montpellier (FR); Laurent Le Mellec, Pluvigner (FR)

(73) Assignee: Hill-Rom Services, Inc., Batesville, IN (US)

( * ) Notice: Subject to any disclaimer, the term of this patent is extended or adjusted under 35 U.S.C. 154(b) by 131 days.

(21) Appl. No.: 16/554,815

(22) Filed: Aug. 29, 2019

(65) Prior Publication Data

US 2020/0069493 A1 Mar. 5, 2020

Related U.S. Application Data

(60) Provisional application No. 62/725,628, filed on Aug. 31, 2018.

(51) Int. Cl.
*A61G 7/10* (2006.01)
*A61G 7/00* (2006.01)

(52) U.S. Cl.
CPC ..... *A61G 7/1001* (2013.01); *A61G 7/001* (2013.01); *A61G 7/1017* (2013.01); (Continued)

(58) Field of Classification Search
CPC ..... A61G 7/10; A61G 7/001; A61G 7/1017; A61G 7/1044; A61G 7/1051; (Continued)

(56) References Cited

U.S. PATENT DOCUMENTS 429,716 A 6/1890 Bishop
552,672 A 1/1896 Souney et al.
(Continued)

FOREIGN PATENT DOCUMENTS

DE 202015002146 U1 5/2015
EP 1819308 B1 10/2011
(Continued)

OTHER PUBLICATIONS

Extended Search Report of EP Counterpart Application No. 19194779.5-1113, dated Jan. 7, 2020, 8 pages.
(Continued)

*Primary Examiner* — David R Hare
*Assistant Examiner* — Madison Emanski
(74) *Attorney, Agent, or Firm* — Barnes & Thornburg LLP

(57) ABSTRACT

A system for turning a patient supported on a patient support apparatus includes a U-shaped frame and a rectangular frame pivotably coupled to the U-shaped frame. The rectangular frame includes first and second sheet grippers configured to removeably couple a plurality of sheets to the system and secure the patient between the sheets. The rectangular frame, the sheets, and the patient are configured to rotate at least 180 degrees relative to the U-shaped frame after the U-shaped frame, the rectangular frame, the sheets, and the patient are raised at least a clearance distance above the patient support apparatus.

20 Claims, 15 Drawing Sheets

(52) U.S. Cl.
CPC ..... *A61G 7/1044* (2013.01); *A61G 7/1051* (2013.01); *A61G 7/1055* (2013.01); *A61G 2200/325* (2013.01); *A61G 2200/327* (2013.01)

(58) Field of Classification Search
CPC ..... A61G 7/1055; A61G 2200/325; A61G 2200/327; A61H 2201/1436; A47B 2220/0094; B29C 66/8225
See application file for complete search history.

(56) References Cited

U.S. PATENT DOCUMENTS 885,329 A 4/1908 Ellis
1,644,043 A 10/1927 Tiedemann
1,667,982 A 5/1928 Pearson
1,698,754 A 1/1929 Gadbois
1,780,399 A 11/1930 Munson
1,990,357 A 2/1935 Ward
2,103,693 A 12/1937 Pohl
2,188,592 A 1/1940 Cunningham
2,239,821 A 4/1941 Knox
2,499,101 A 2/1950 Kluglein
2,534,471 A 12/1950 Norheim
2,613,371 A 10/1952 Keyes, Jr.
2,655,667 A 10/1953 Burkert
2,690,177 A 9/1954 Hogan
2,812,524 A 11/1957 Pruitt
3,034,152 A 5/1962 Stryker
3,049,726 A 8/1962 Getz
3,226,734 A 1/1966 Coventon
3,238,539 A 3/1966 Koch
3,302,218 A 2/1967 Stryker
3,302,219 A 2/1967 Harris
3,386,111 A 6/1968 Daniel
3,526,908 A 9/1970 Davis
3,568,669 A 3/1971 Stites
3,750,199 A 8/1973 Spivey
3,827,089 A 8/1974 Grow
3,832,742 A 9/1974 Stryker
3,895,403 A 7/1975 Davis
3,924,281 A 12/1975 Gibbs
4,109,329 A 8/1978 Tupper
4,244,358 A 1/1981 Pyers
4,356,577 A 11/1982 Taylor et al.
4,937,901 A * 7/1990 Brennan ..... A61G 7/001 5/607
5,068,931 A 12/1991 Smith
5,088,706 A 2/1992 Jackson
5,131,106 A 7/1992 Jackson
5,168,587 A 12/1992 Shutes
5,524,304 A 6/1996 Shutes
5,659,905 A 8/1997 Palmer, Jr. et al.
5,720,059 A * 2/1998 Allevato ..... A61G 7/005 5/610
5,868,380 A * 2/1999 Allen ..... B66D 3/10 254/391
6,065,165 A 5/2000 Delk et al.
6,282,736 B1 9/2001 Hand et al.
6,378,148 B1 4/2002 Votel
6,496,991 B1 12/2002 Votel
6,526,610 B1 3/2003 Hand et al.
6,566,833 B2 5/2003 Bartlett
6,568,015 B1 5/2003 Allen
6,671,905 B2 1/2004 Bartlett et al.
6,691,347 B2 2/2004 Hand et al.
6,772,456 B2 8/2004 Votel
6,862,761 B2 3/2005 Hand et al.
7,111,338 B2 9/2006 Faux et al.
7,137,160 B2 11/2006 Hand et al.
7,197,778 B2 4/2007 Sharps
7,290,299 B2 11/2007 Votel
7,290,302 B2 11/2007 Sharps
7,653,953 B2 2/2010 Lopez-Sansalvador
7,725,964 B2 6/2010 Minning et al.
8,042,208 B2 10/2011 Gilbert et al.
8,336,138 B2 12/2012 Newkirk et al.
8,677,529 B2 3/2014 Jackson et al.
8,707,476 B2 4/2014 Sharps
8,707,484 B2 4/2014 Jackson et al.
8,719,979 B2 5/2014 Jackson
8,763,177 B2 7/2014 Shah et al.
8,826,474 B2 9/2014 Jackson
8,826,475 B2 9/2014 Jackson
8,839,471 B2 9/2014 Jackson
8,844,077 B2 9/2014 Jackson et al.
8,856,986 B2 10/2014 Jackson
8,938,826 B2 1/2015 Jackson
8,978,180 B2 3/2015 Jackson
9,072,646 B2 7/2015 Skripps et al.
9,180,062 B2 11/2015 Jackson
9,186,291 B2 11/2015 Jackson et al.
9,192,535 B2 * 11/2015 Sverdlik ..... A61G 7/1015
9,198,817 B2 12/2015 Jackson
9,205,013 B2 12/2015 Jackson
9,211,223 B2 12/2015 Jackson
9,226,865 B2 1/2016 Jackson et al.
9,233,037 B2 1/2016 Sharps et al.
9,265,679 B2 2/2016 Jackson
9,265,680 B2 2/2016 Sharps et al.
9,289,342 B2 3/2016 Jackson
9,295,433 B2 3/2016 Jackson et al.
9,301,897 B2 4/2016 Jackson
9,308,145 B2 4/2016 Jackson
9,339,430 B2 5/2016 Jackson et al.
9,358,170 B2 6/2016 Jackson
9,364,380 B2 6/2016 Jackson
9,402,775 B2 8/2016 Jackson et al.
9,456,945 B2 10/2016 Jackson
9,468,576 B2 10/2016 Jackson
9,474,671 B2 10/2016 Sharps et al.
9,498,397 B2 11/2016 Hight et al.
9,504,622 B2 11/2016 Jackson
9,510,987 B2 12/2016 Jackson et al.
9,549,863 B2 1/2017 Jackson et al.
9,561,145 B2 2/2017 Jackson et al.
9,572,734 B2 2/2017 Jackson et al.
9,597,247 B2 3/2017 Shah et al.
9,610,206 B2 4/2017 Jackson
9,622,928 B2 4/2017 Jackson et al.
9,629,766 B2 4/2017 Jackson et al.
9,636,266 B2 5/2017 Jackson et al.
9,642,760 B2 5/2017 Jackson et al.
9,655,793 B2 5/2017 Hertz
9,687,399 B2 6/2017 Jackson et al.
9,744,087 B2 8/2017 Jackson
9,744,089 B2 8/2017 Jackson
9,757,300 B2 9/2017 Jackson
9,849,054 B2 12/2017 Jackson
9,877,883 B2 1/2018 Jackson et al.
9,889,054 B2 2/2018 Jackson et al.
9,937,094 B2 4/2018 Jackson et al.
9,968,503 B2 5/2018 Hight et al.
10,363,189 B2 7/2019 Hight et al.
10,426,684 B2 10/2019 Dubois

FOREIGN PATENT DOCUMENTS

EP 2431016 B1 3/2016
FR 2924332 A1 6/2009
GB 2130482 B 4/1986

OTHER PUBLICATIONS

Machine translation of FR2924332A1, accessed on Apr. 7, 2020, 18 pages.

* cited by examiner

PATIENT TURNING SYSTEM

PRIORITY CLAIM

This application claims priority under 35 U.S.C. § 119(e) to U.S. Provisional Application No. 62/725,628, filed Aug. 31, 2018, which is expressly incorporated by reference herein.

BACKGROUND

The present disclosure relates to an apparatus and method that allows for a caregiver to move a patient and, more particularly, to a method and apparatus for repositioning the patient between a supine position and a prone position by rotating the patient about an axis of rotation.

Caregivers are required at times to rotate a patient positioned on a patient support apparatus. This may be done for a variety of reasons including repositioning of the patient in preparation for a procedure, avoiding bed sores and other skin irritations, and/or providing comfort or pain relief to the patient. The patient needing to be repositioned may be larger than the caregiver and require more than one caregiver to achieve the desired positioning of the patient. Further, often only a limited number of caregivers may be available to assist with patient rotation. At times, a single caregiver may be tasked with repositioning the patient from the supine position to the prone position or vice versa. In such situations, the caregiver may not have the physical strength necessary to reposition the patient. As such, the caregiver places herself/himself/themself at risk for physical injury by attempting to rotate the patient without assistance and, additionally, patients in need of repositioning may not receive the necessary treatment due to the physical limitation on the caregiver. Patients unable to be repositioned by a single caregiver face increased risk of bed sores and illnesses related thereto.

SUMMARY

The present disclosure includes one or more of the features recited in the appended claims and/or the following features which, alone or in any combination, may comprise patentable subject matter.

In a first aspect of the present disclosure, a patient turning apparatus for turning a patient by 180 degrees relative to a mattress of a bed supporting the patient, the patient being situated between a pair of sheets, and for use with an overhead lift having a motor that operates to extend and retract a lifting strap includes a U-shaped frame having an elongated, horizontally oriented, upper segment, a first segment extending generally vertically downwardly from a head end of the upper segment, a second segment extending generally vertically downwardly from a foot end of the upper segment, and a coupler situated at a middle region of the upper segment and configured to attach to a lower end of the lift strap of the overhead lift. The patient turning apparatus further includes a rectangular frame having elongated first and second sheet grippers at the sides of the rectangular frame, a head end frame member at a head end of the rectangular frame, and a foot end frame member at a foot end of the rectangular frame. The middle regions of the head end frame member and the foot end frame member are pivotably coupled to lower ends of the first and second segments, respectively, of the U-shaped frame so that the rectangular frame is rotatable about a longitudinally extending pivot axis relative to the U-shaped frame. Further, the rectangular frame is sized to surround the patient when the rectangular frame is resting upon the mattress. The pair of sheets is coupled to each of the first and second sheet grippers to tightly sandwich the patient between the pair of sheets to permit the rectangular frame and the patient to be rotated by 180 degrees relative to the U-shaped frame after the overhead lift is operated to raise the U-shaped frame, the rectangular frame, and the patient upwardly away from the mattress by a sufficient distance to provide clearance between the rotating rectangular frame and the mattress.

In some embodiments, the patient turning apparatus further includes at least one rotation mechanism coupled to the first segment of the U-shaped frame at an upper surface of the rotation mechanism and further coupled to the head end frame member at a pair of opposing lateral sides.

In some embodiments, the rotation mechanism is configured to move between an unlocked state and a locked state by actuation of a rotation lock mechanism moveably coupled to the first segment and configured to engage the rotation mechanism and block rotation of the rotation mechanism when the rotation mechanism is in the locked state.

In some embodiments, the rotation mechanism includes an anchor and an anchor receiver, the anchor is formed to include a body and an extension extending away the body through the anchor receiver, the anchor receiver is formed to include an aperture pivotably engaging the extension, the extension is sized to terminate in an anchor retainer having a greater height than the aperture formed in the anchor receiver.

In some embodiments, the rotation mechanism further includes a damper positioned between the body of the anchor and the anchor receiver, the rotation mechanism is configured to decrease the speed of rotation of the patient around the axis.

In some embodiments, the patient turning apparatus further includes a rotation locking mechanism coupled to the body of the anchor and sized to extend a length of the anchor receiver and removeably couples to a top section of the anchor receiver.

In some embodiments, the patient turning apparatus also includes a sheet attachment mechanism coupled to an outer surface of the first gripper and the second gripper configured to removeably couple the sheets to the sheet grippers.

In some embodiments, the sheet attachment mechanism includes a plurality of gripper strips coupled to the outer surface of the first gripper and the second gripper and a plurality of sheet strips coupled to a bottom surface of the sheets at a pair of lateral edges of each of the sheets, the sheet strips are configured to removeably couple to the gripper strips.

In some embodiments, the gripper strips and the sheet strips are sized to extend a length of the grippers from an upper end of the grippers to the lower end of the grippers, the sheet strips and gripper strips are further sized to have a same width such that the sheet strips grippers strips are configured to be positioned to be directly on top of the gripper strips.

In some embodiments, the patient turning apparatus further includes a sheet tensioning mechanism coupled to the sheet grippers at a lower end of each gripper and configured to rotate the sheet grippers about the axis in both a sheet-tensioning direction and a sheet-releasing direction.

In some embodiments, the sheet tensioning mechanism includes a housing coupled to the lower end of each of the grippers and a ratchet assembly located within the housing such that each gripper is configured to rotate independently of the opposite gripper.

In some embodiments, the sheet tensioning mechanism includes a sheet-tensioning mechanism housing coupled to a pair of lower ends of the grippers and a pair of ratchet assemblies coupled to an configured to rotate the grippers, a majority of the ratchet assemblies is located within the sheet-tensioning mechanism housing such that each gripper is configured to rotate independently of the other.

In some embodiments, the ratchet assembly includes a gear in communication configured to be rotated about the axis and a ratchet release mechanism configured to engage the gear and control rotation of the grippers.

In a second aspect of the present disclosure, a method of turning a patient by 180 degrees relative to a mattress of a bed supporting the patient, the method includes attaching a U-shaped frame to a lower end of a lift strap of an overhead lift. The method further includes positioning the overhead lift so that the U-shaped frame is generally aligned with a sagittal plane of the patient lying in a supine position on the mattress with the U-shaped frame being oriented upside down so that head end and foot end segments of the U-shaped frame extend downwardly from an upper segment of the U-shaped frame. The method of turning the patient also includes lowering the U-shaped frame downwardly so that a substantially rectangular frame which is pivotably coupled to lower ends of the head end and foot end segments is lowered to a position to surround the patient, coupling a pair of sheets to first and second sheet grippers situated along elongated sides of the substantially rectangular frame to tightly sandwich the patient between the pair of sheets, and operating the overhead lift to raise the U-shaped frame, the substantially rectangular frame, the pair of sheets, and the patient upwardly so that the mattress no longer supports the patient. The method further includes pivoting the substantially rectangular frame by about 180 degrees relative to the U-shaped frame to move the patient from the supine position to a prone position and operating the overhead lift to lower the U-shaped frame, the substantially rectangular frame, the pair of sheets, and the patient downwardly so that the mattress once again supports the patient with the patient being in the prone position.

In some embodiments, the method for turning a patient further includes uncoupling the pair of sheets from the first and second grippers after rotating the substantially rectangular frame by about 180 degrees and lowering the overhead lift.

In some embodiments, the method further includes actuating a rotation locking mechanism such that the rotation locking mechanism is placed in an unlocked position, allowing for the pivoting of the substantially rectangular frame.

In some embodiments, uncoupling the pair of sheets from the first and second grippers after rotating the substantially rectangular frame by about 180 degrees and lowering the overhead lift includes actuating a ratchet release of the sheet tensioning mechanism formed in an outer surface of the first and second grippers, removing the pair of sheets from engagement with the first and second sheet grippers to release the patient from between the pair of sheets, operating the overhead lift to raise the U-shaped frame and the substantially rectangular frame upwardly so that the mattress no longer supports the substantially rectangular frame, and detaching the U-shaped frame from the lower end of the lift strap of the overhead lift such that the U-shaped frame and the substantially rectangular frame are uncoupled from the overhead lift and configured to be coupled to a second overhead lift located in a second patient room.

In some embodiments, actuating the ratchet release comprises moving the ratchet release out of engagement with a biasing member coupled to a pawl, thereby permitting rotation of the first and second grippers about a rotation axis in a sheet-tensioning direction and a sheet-releasing direction.

In some embodiments, removing the pair of sheets from engagement with the first and second grippers to release the patient from between the pair of sheets includes the steps of rotating the first and second grippers about a rotation axis in a sheet-releasing direction until a furthermost lateral edge of a second sheet is positioned such that it may be accessed by a caregiver and moving the ratchet release into engagement with a biasing member coupled to a pawl to block rotation of the first and second grippers in the sheet-releasing direction about the rotation axis.

In some embodiments, removing the pair of sheets from engagement with the first and second grippers to release the patient from between the pair of sheets further includes the steps of gripping the furthermost lateral edge of the second sheet, uncoupling the second sheet from the first and second grippers by pulling the second sheet away from the first and second grippers thereby exposing a first sheet coupled to the first and second grippers, gripping a furthermost lateral edge of the first sheet, and uncoupling the first sheet from the first and second grippers by pulling the first sheet away from the first and second grippers.

Additional features, which alone or in combination with any other feature(s), such as those listed above and/or those listed in the claims, can comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DISCLOSURE

Figure 1:
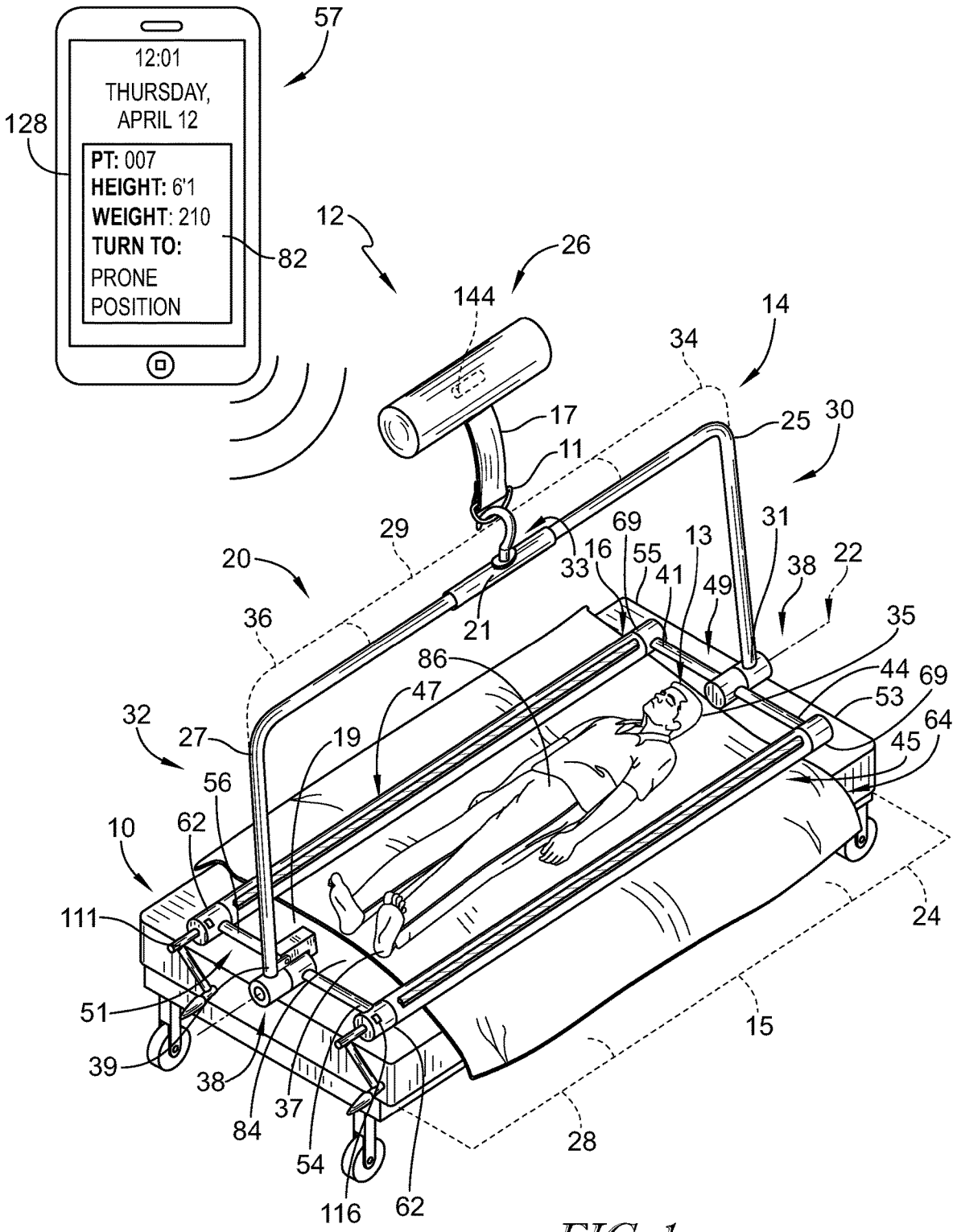
FIG. 1 is a perspective view of a system for turning a patient in accordance with the present disclosure showing that the patient turning system includes a U-shaped frame and a rectangular frame pivotably coupled to the U-shaped frame and in electronic communication with a controller.
Figure 15:
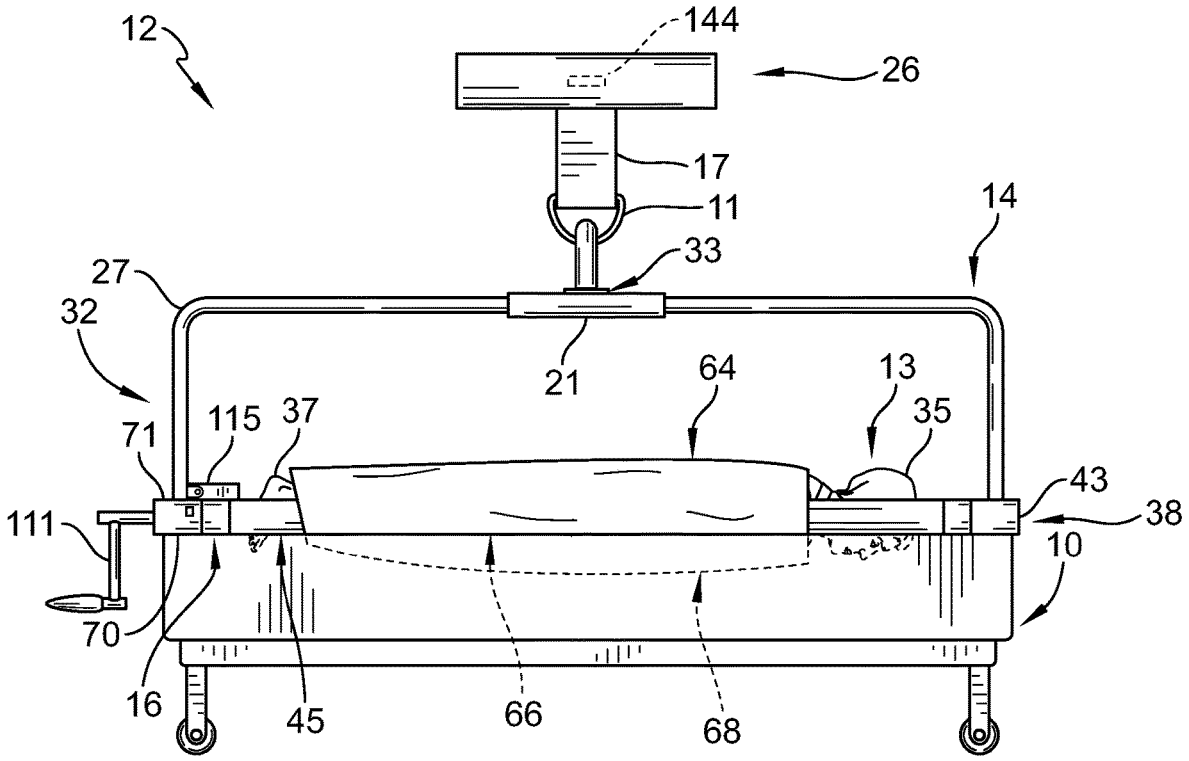
FIG. 15 is a side view similar to FIG. 14 showing the system and the patient engaged with and positioned on top of the patient support apparatus such that the second sheet is positioned between the patient and the patient support apparatus.

A system 12 for turning a patient 13 in accordance with the present disclosure is adapted for use with a patient support apparatus 10 such as, for example, a hospital bed as shown in FIG. 1. The patient turning system 12 is independent of the patient support apparatus 10 and configured to removeably couple to a lift strap 17 of a motorized ceiling lift 26 to create a distance 80 between the patient 13 and the patient support apparatus 10 in preparation for rotation of the patient 13 between a supine position, as shown in FIG. 1, and a prone position, as shown in FIG. 15.

Because the patient turning system 12 is coupled to the ceiling lift 26 and is independent of the patient support apparatus 10, the patient turning system 12 may be used with a variety of patient support apparatuses 10. Further, the patient turning system 12 may be obtained as an aftermarket accessory separate from the patient support apparatus 10. As a result, the patient turning system 12 may initially be located in a first patient's room in a health care facility and coupled to the ceiling lift 26 located in the first patient's room. The caregiver may then use the patient turning system 12 to rotate the first patient 13 without additional assistance via a lift controller 57 in electronic communication with the ceiling lift 26 and configured to receive user inputs 82 as shown in FIG. 1. After treatment is complete and/or the first patient 13 no longer needs the patient turning system 12, the caregiver may uncouple the system 12 from the lift strap 17 and position the system 12 in the room of a second patient. As such, the system 12 is configured to be portable between locations and may be used with patients 13 having a wide variety of ailments.

Figure 2:
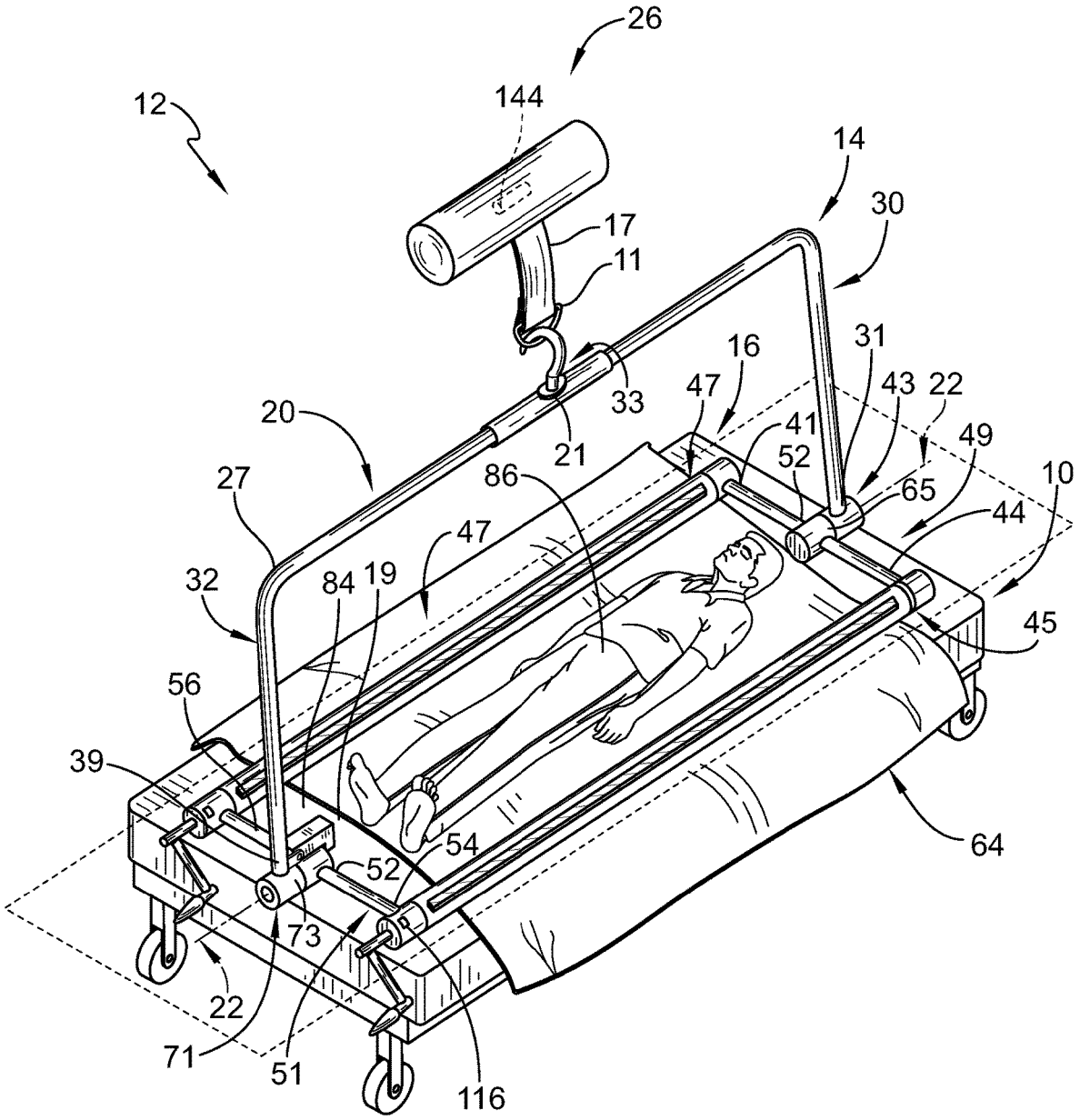
FIG. 2 is a perspective view of the system similar to FIG. 1 showing that the U-shaped frame is removeably coupled to a ceiling lift and the rectangular frame is configured to removeably couple to a first sheet positioned between the patient and an upper surface of the patient support apparatus.
Figure 6:
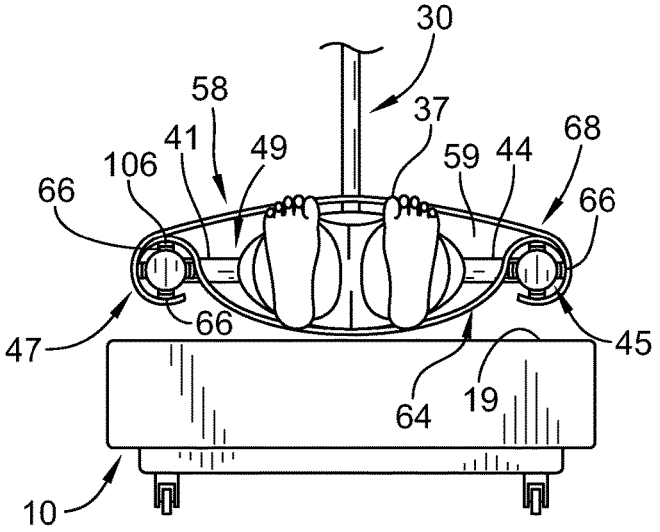
FIG. 6 is an end view similar to FIG. 5 showing the first and second sheets removeably coupled to the grippers with increased tension formed in the sheets due to the actuation of a sheet tensioning mechanism by the caregiver such that a pocket is formed between the sheets and around the patient.
Figure 7:
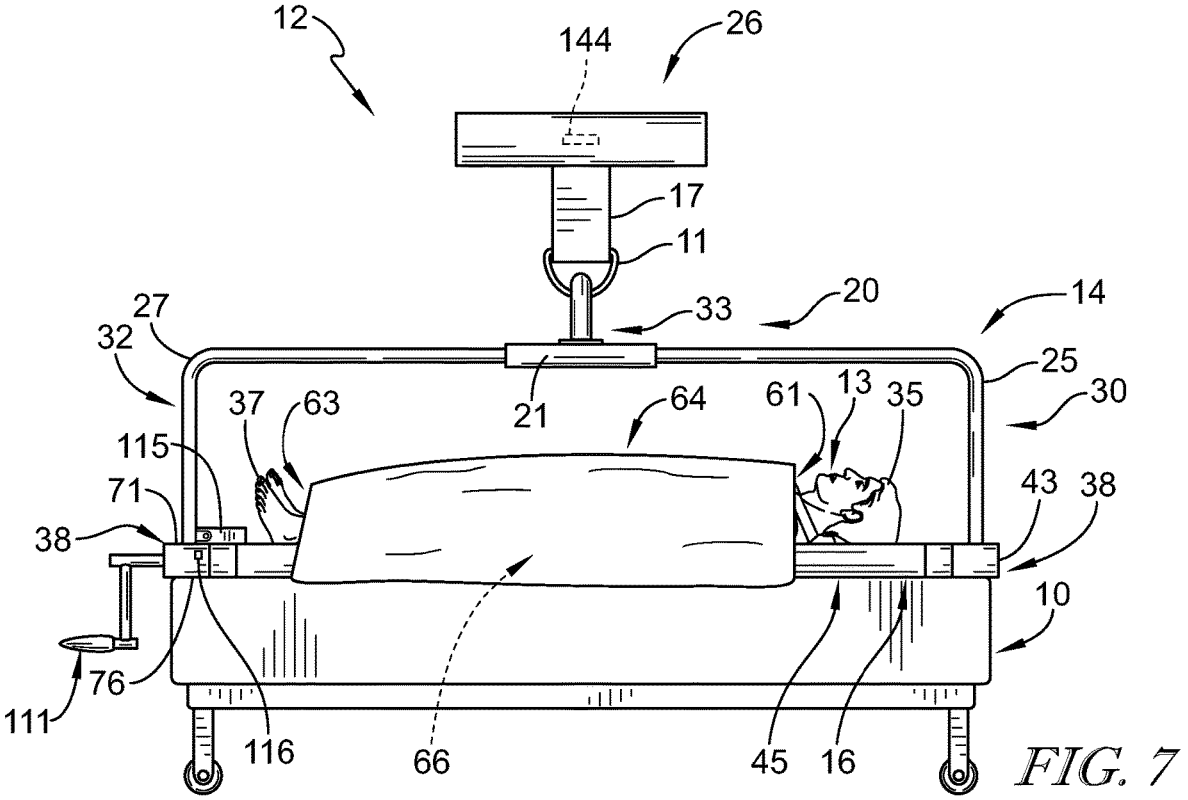
FIG. 7 is a side view similar to FIG. 6 showing the patient located in the pocket and suggesting that the patient is positioned between the sheets such that the patient will not move within the pocket during rotation.
Figure 8:
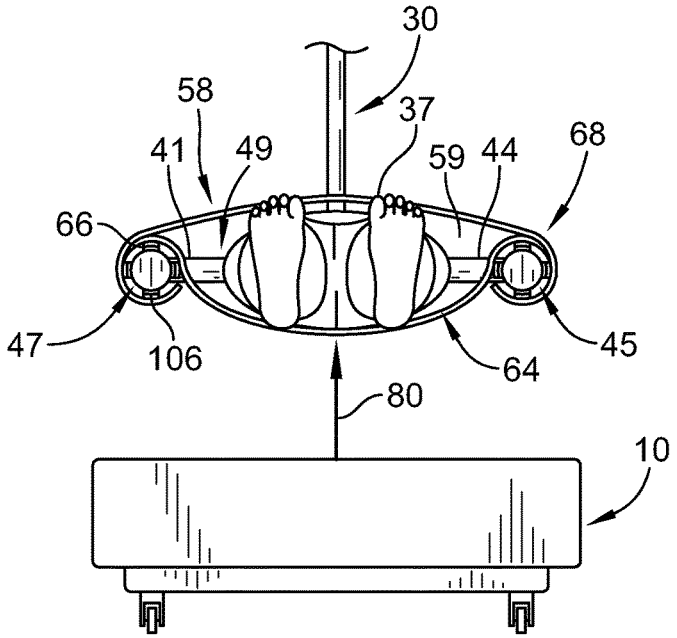
FIG. 8 is an end view similar to FIG. 6 and showing the U-shaped frame, the rectangular frame, and the patient vertically spaced apart from the patient support apparatus and suggesting that a distance is created between the patient and the patient support apparatus such that the patient may be rotated without interference by the patient support apparatus or other devices coupled thereto.
Figure 9:
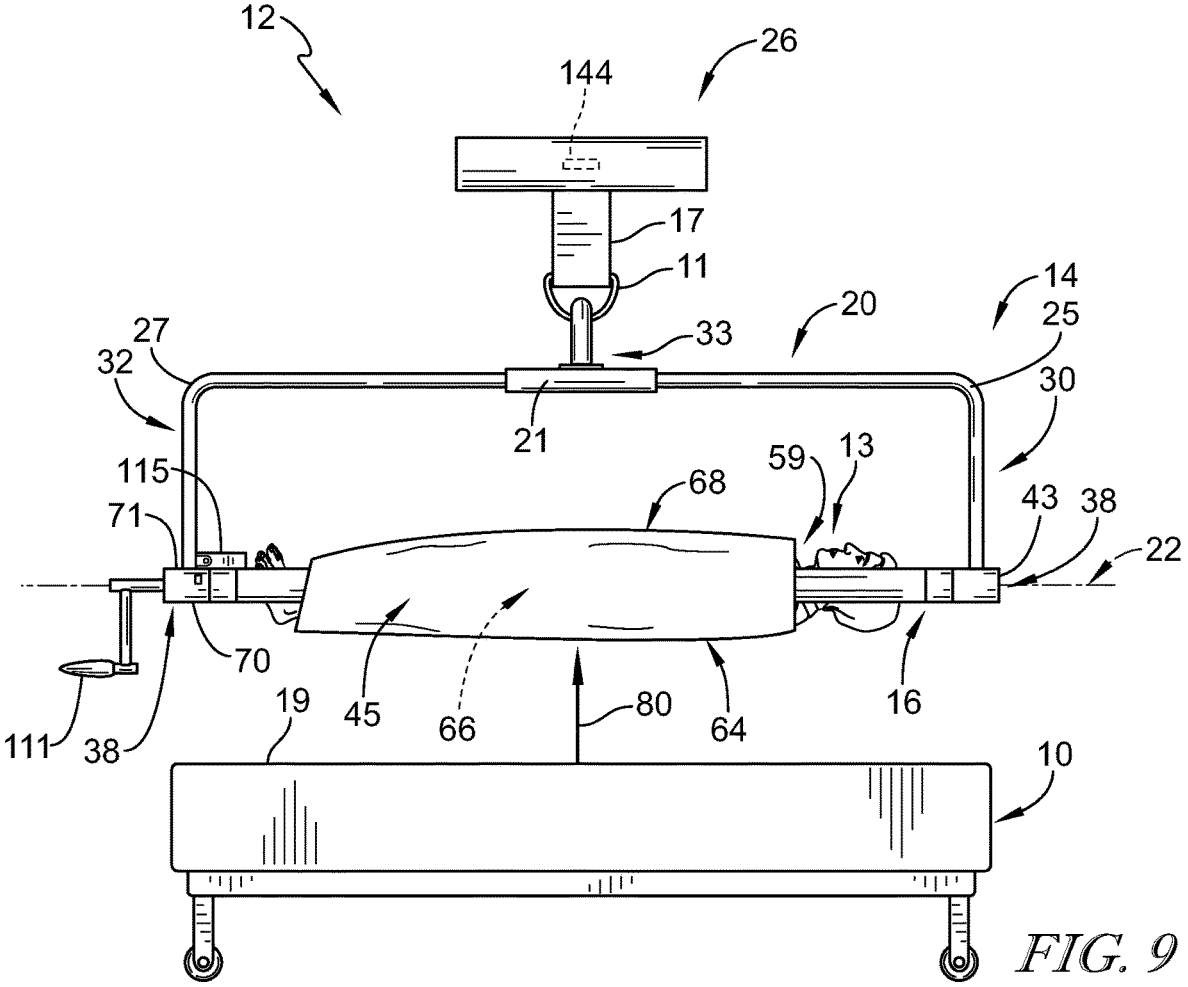
FIG. 9 is a side view similar to FIG. 8 showing the U-shaped frame, the rectangular frame, and the patient vertically spaced apart from the patient support apparatus in response to the retraction of a lift strap included in the motorized ceiling lift.
Figure 11:
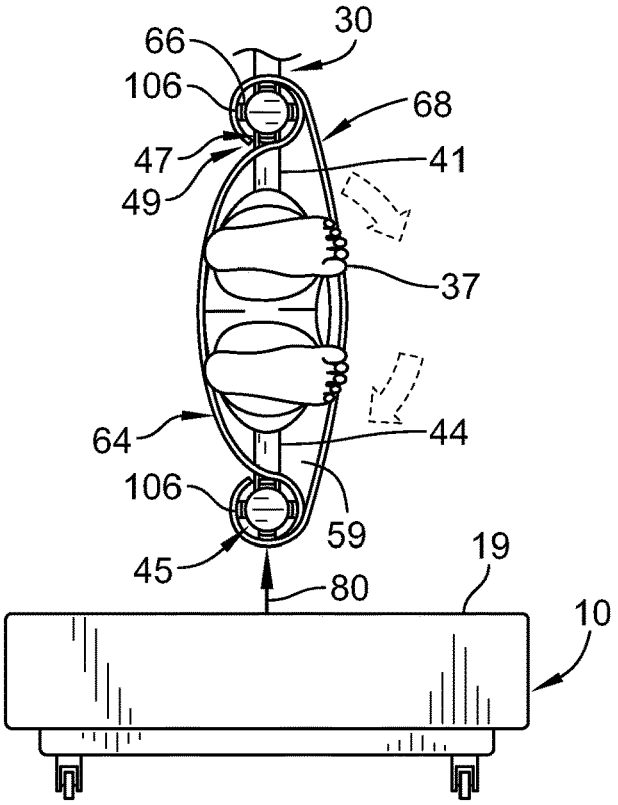
FIG. 11 is an end view similar to FIG. 10 showing the system and the patient at a point during the rotation of the patient from the supine to prone position and suggesting that the system is configured to further rotate the patient to the prone position.
Figure 12:
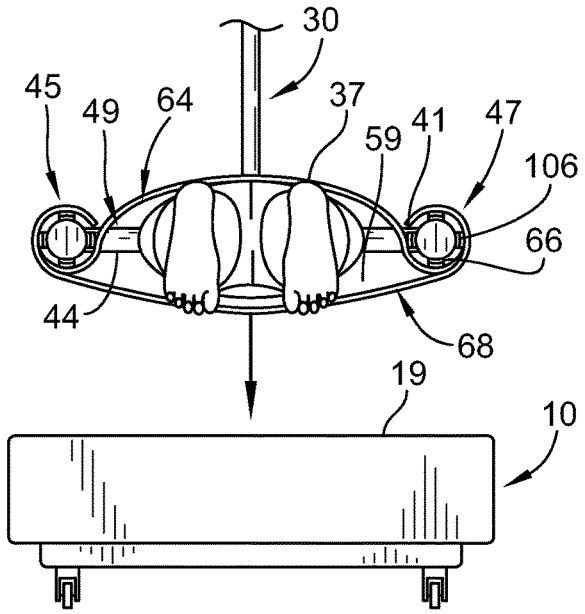
FIG. 12 is an end view similar to FIGS. 10 and 11 showing the system and the patient spaced apart from and positioned above the patient support apparatus and the patient in the prone position after the rotation as shown in FIGS. 10 and 11 suggesting that the patient and system are lowered onto the patient support apparatus after rotation of the patient is complete.
Figure 13:
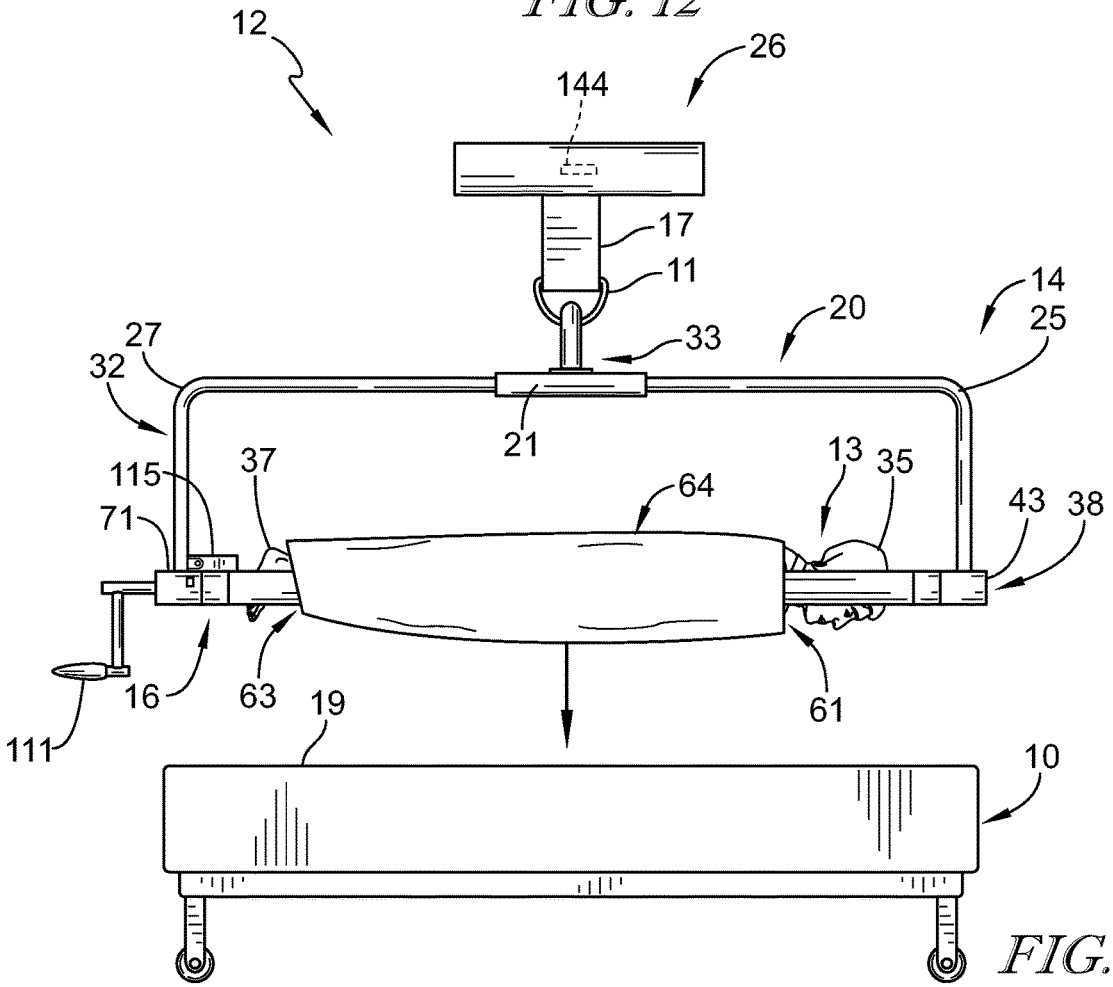
FIG. 13 is a side view similar to FIG. 12 showing the system and the patient spaced apart from and positioned above the patient support apparatus with the patient positioned in the prone position and suggesting that the system and the patient are configured to be lowered downwardly towards the patient support apparatus such that the patient and the system rest on the upper surface of the patient support apparatus.

Referring to FIGS. 1 and 2, the patient turning system 12 includes a U-shaped frame 14 and a rectangular frame 16 coupled to the U-shaped frame 14. The U-shaped frame 14 is removeably coupled to the motorized lift 26 via the lift strap 17. The rectangular frame 16 is, illustratively, positioned around the patient 13 and configured to move with the U-shaped frame 14. As the motorized lift 26 retracts the lift strap 17, the system 12 is moved in an upward direction toward the ceiling lift 26 such that the system 12 is spaced apart from a surface region 19 of the patient care apparatus 10 and the patient 13 is moved from a lowered position, as shown in FIGS. 1-7, to a raised position, as shown in FIGS. 8 and 9. The system 12 further includes a rotation mechanism 38 coupled to both the U-shaped frame 14 and the rectangular frame 16. The rotation mechanism 38 is electronically controllable by the caregiver to move the patient 13 between a first spaced-apart rotation position, as shown in FIGS. 8-10, a second spaced-apart rotation position, as shown in FIG. 11, and a third spaced-apart rotation position, as shown in FIGS. 12 and 13.

Figure 10:
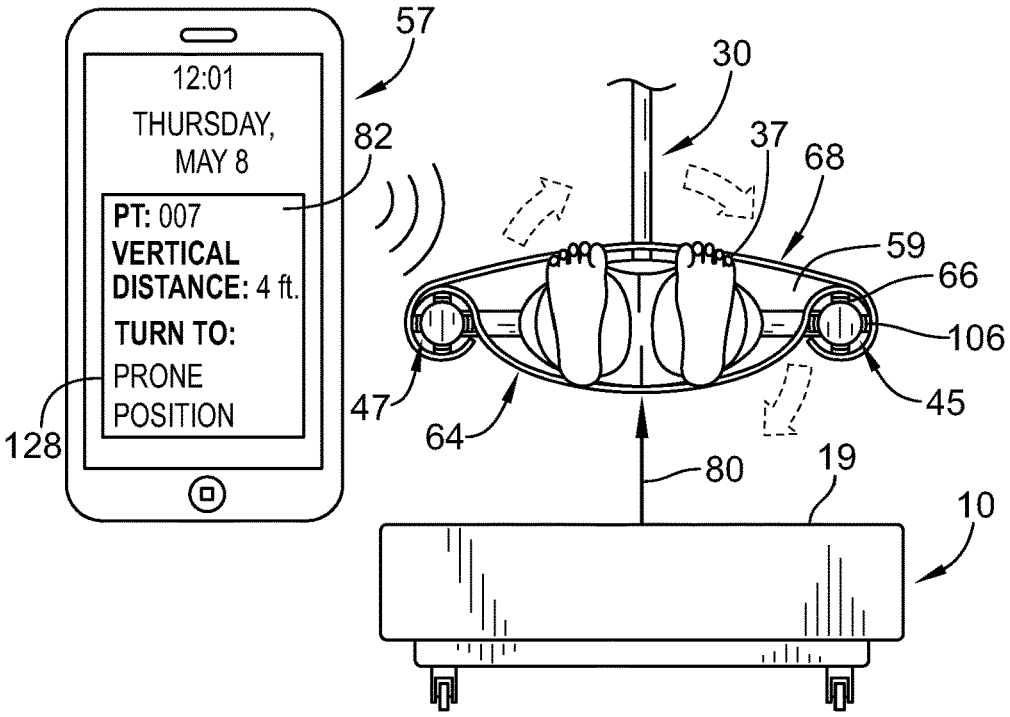
FIG. 10 is an end view showing the U-shaped frame, the rectangular frame, and the patient vertically spaced apart from the patient support apparatus and suggesting that the patient turning system is configured to rotate the patient from the supine position to a prone position about a rotation axis.
Figure 14:
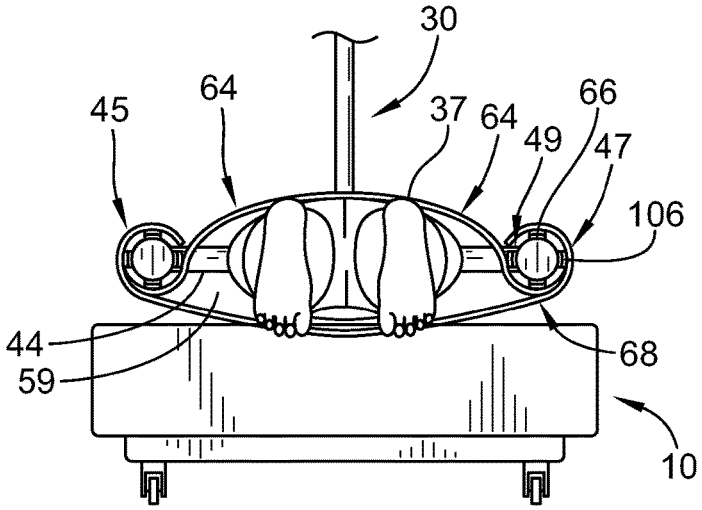
FIG. 14 is an end view showing the system and the patient engaged with and positioned top of the patient support apparatus such that the patient is once again resting on the upper surface of the patient support apparatus in the prone position.

In the first spaced-apart rotation position, as shown in FIGS. 8-10, the patient 13 is positioned such that the patient 13 is facing in a substantially upward direction away from the patient support apparatus 10 such that the patient's view is directed upwardly towards the ceiling lift 26. Further, the patient 13 is aligned with a rotation axis 22 in a supine position. The system 12 is further configured to move the patient 13 to the second spaced-apart rotation position as shown in FIG. 11. When in the second spaced-apart rotation position, the patient 13 is partially rotated about the rotation axis 22 such that at least one of the grippers 45, 47 is positioned nearest to the ceiling lift 26 in relation to the patient 13. Further, each of the grippers 45, 47 are vertically aligned with the rotation axis 22. The system 12 is also configured to move the patient 13 to the third spaced-apart rotation position as shown in FIGS. 12 and 13. In the third spaced-apart rotation position, the patient 13 remains spaced apart from the patient support apparatus 10 and is positioned to face in a substantially downward/prone direction towards the patient support apparatus 10. Further each of the grippers 45, 47 are horizontally aligned with the rotation axis 22. The caregiver may further instruct the ceiling lift 26 to extend the lift strap 17 and move the patient 13 into the lowered position as shown in FIGS. 14 and 15 such that the patient once again engages an upper surface 19 of the patient support apparatus 10.

As the caregiver extends and retracts the ceiling lift 26 via the controller 57 via the lift strap 17, the patient 13 is moved between the lowered position, in which the patient 13 is engaged with the patient support apparatus 10, and the raised position, in which the patient 13 is spaced apart from the patient support apparatus 10. The longitudinal axis 22 extends from a head section 24 of the mattress 10 to a foot section 28 of the mattress 10. As the patient 13 is moved between the lowered and raised positions, a first segment 30 and a second segment 32 of the U-shaped frame 14 move perpendicularly along the longitudinally extending axis 22.

As described above, the U-shaped frame 14 includes the upper segment 20, the first segment 30, the second segment 32, and a coupler 33 as shown in FIGS. 1 and 2. The upper segment 20 is coupled to the first segment 30 at an upper end 25 of the first segment 30. The first segment 30 extends generally vertically downwardly from the upper segment 20 towards the mattress 10. Further, the upper segment 20 is coupled to the second segment 32 at an upper end 27 of the second segment 32. The second segment 32 is spaced apart from the first segment 30 and extends generally vertically downwardly from the upper segment 20 towards the mattress 10 thereby forming the substantially U-shaped frame 14. The upper segment 20 is further coupled to the coupler 33 spaced apart from and positioned in between the first segment 30 and the second segment 32 at a mid-point 21 of the upper segment 20. The components 20, 30, 32, 33 of the U-shaped frame 14 are configured to cooperate to move the rectangular frame 16 and thereby move the patient 13 upwardly away from the mattress such that the distance 80 is created. The distance 80 is sized such that it allows for the rotation of the patient 13 about the pivot axis 22 without interference.

The upper segment 20 of the U-shaped frame 14 is illustratively positioned above the patient support apparatus 10 and parallel to the longitudinal pivot axis 22 such that the upper segment 20 is sized to extend at least the length of the mattress 10. The upper segment 20 includes a head end 34 positioned over a head section 24 of the mattress 10, a foot end 36 positioned over a foot section 28 of the mattress, and a middle region 29 extending therebetween over a body section 15 of the mattress 10. The head end 34 is coupled to the first segment 30 such that the first segment 30 extends generally downwardly towards the mattress 10 and terminates at the rectangular frame 16 spaced apart from and positioned above a head 35 of the patient 13. The foot end 36 of the upper segment 20 is coupled to the second segment 32 such that the second segment 32 extends generally vertically downwardly towards the mattress 10 and terminates at the rectangular frame 16 spaced apart from and positioned below the feet 37 of the patient 13. The middle region 29 is coupled to the coupler 33 such that the coupler 33 is located generally at the mid-point 21 of the upper segment 20 and is configured to removeably couple to the lift strap 17 of the overhead lift 26. Illustratively, the coupler 33 includes a hook 11 configured to engage the lift strap 17 and removeably couple the system 12 to the ceiling lift 26.

Figure 3:
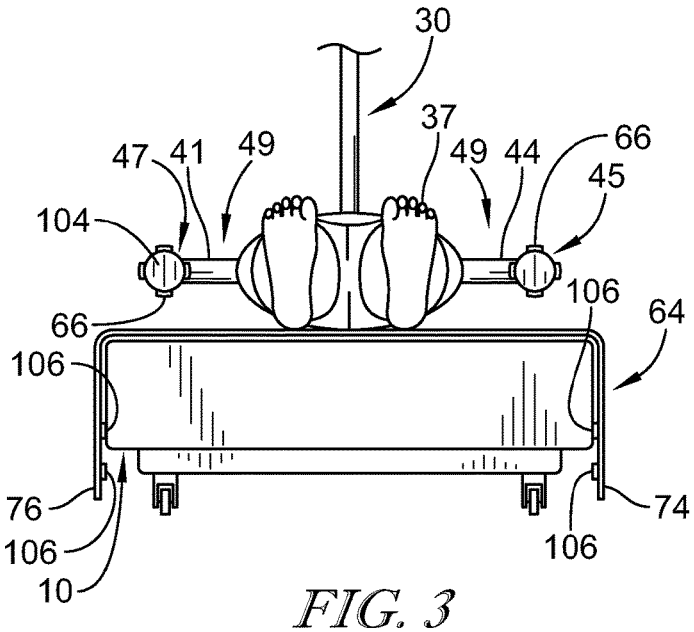
FIG. 3 is an end view, similar to FIGS. 1 and 2, of the patient positioned in a supine position on the patient support apparatus and showing a pair of grippers included in the rectangular frame before a caregiver positions the first sheet on top of the grippers.

The rectangular frame 16 is sized to surround the patient 13 and is pivotably coupled to the U-shaped frame 14 at a lower end 31, 39 of the first segment 30 and the second segment 32, respectively. The rectangular frame 16 includes an elongated first and second sheet gripper 45, 47, a head end frame member 49, and a foot end frame member 51. The first and second sheet grippers 45, 47 are spaced apart from each other and located on a pair of lateral sides 53, 55, of the mattress 10 and shaped to form a space 84 between the grippers 45, 47 sized to receive the patient 13. Illustratively, the grippers 45, 47 are positioned on top of the patient support apparatus 10 adjacent to the upper surface region 19 of the mattress 10 and are configured to flank the patient 13 as shown in FIGS. 1-3. The grippers 45, 47 are coupled to the head frame end member 49 positioned at the head section 24 of the mattress 10. Specifically, a head end 69 of each of the grippers 45, 47 is coupled to a first end 44 and a second end 41 of the head end frame member 49, respectively.

The head end frame member 49 is positioned above the head 35 of the patient 13 and extends perpendicular to the rotation axis 22 along the width of the mattress 10. The foot end frame member 51 is spaced apart from the head end frame member 49 and positioned below the feet 37 of the patient 13. The foot end frame member 51 extends perpendicular to the rotation axis 22 along the width of the mattress 10 and is coupled to the ends of the grippers 45, 47. Specifically, a foot end 62 of each of the grippers 45, 47 is coupled to the foot end frame member 51 at a first and second end 54, 56, respectively.

Figure 4:
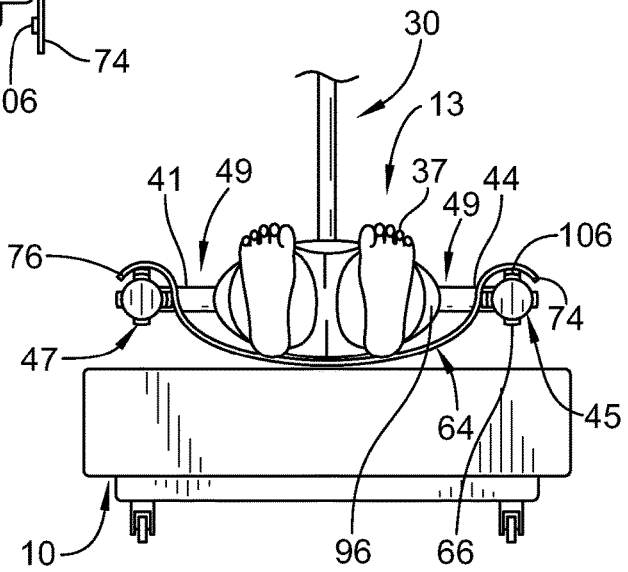
FIG. 4 is an end view similar to FIG. 3 showing the first sheet positioned between the patient and the patient support apparatus and placed on top of the grippers such that a gripper strip coupled to the gripper and a sheet strip coupled to the first sheet are substantially aligned, respectively.
Figure 5:
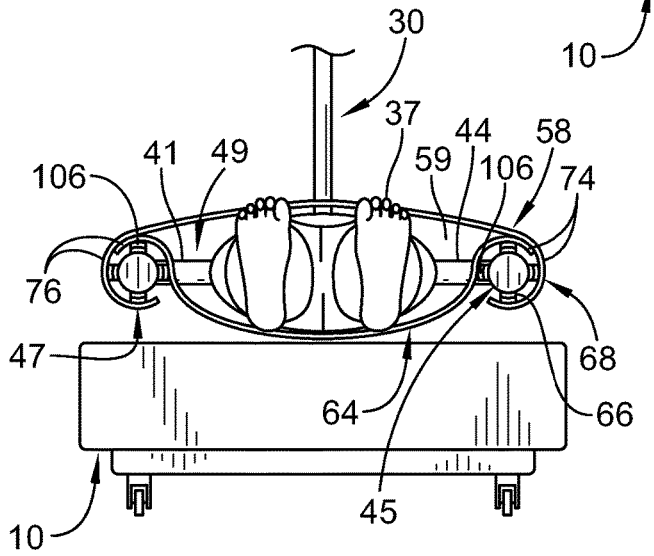
FIG. 5 is an end view similar to FIGS. 3 and 4 and showing a second sheet placed on top of the patient and the grippers such that the gripper strip not yet coupled to the first sheet removeably couples to a sheet strip coupled to the second sheet.

The sheet grippers 45, 47 of the rectangular frame 16 extend parallel to the longitudinal axis 22 between the foot end member 51 and the head end member 49 and cooperate with the members 51, 49 to form the space 84 therebetween. The space 84 is configured to receive the patient 13 located on the patient support apparatus 10. Illustratively, the patient 13 is located at a mid-point 86 of the space 84 so that the patient 13 is positioned substantially equidistance between the first gripper 45 and the second gripper 47. The grippers 45, 47 are configured to couple to a plurality of sheets 58 located on the patient support apparatus 10 as shown in FIG. 4. Illustratively, the plurality of sheets 58 includes a first sheet 64 located on top of the patient support apparatus 10 such that the first sheet 64 is positioned between the mattress 10 and the patient 13. Further, the grippers 45, 47 are configured to be positioned on top of the first sheet 64 such that the first sheet 64 is initially located below the grippers 45, 47. The sheets 58 further include a second sheet 68 located on top of the grippers 45, 47, the first sheet 64, and the patient 13. The sheets 58 cooperate to form a pocket 59 wherein the patient 13 is located. Illustratively, the patient 13 is positioned within the pocket 59 such that the head 35 of the patient 13 extends from a first opening 61 of the pocket 59 and the feet 37 of the patient 13 extend from a second opening 63 of the pocket as shown in FIGS. 5 and 6.

The head end frame member 49 of the rectangular frame 16 includes the first end 44, the second end 41 spaced apart from the first end 44, and a middle region 52 extending therebetween. The first end 44 is pivotably coupled to the gripper 45 and is configured to cooperate with the gripper 45 to rotate about the pivot axis 22. The second end 41 is pivotably coupled to the gripper 47 and is configured to cooperate with the gripper 47 to rotate about the pivot axis 22. The middle region 52 is pivotably coupled to the lower end 31 of the first segment 30 of the U-shaped frame 14 such that the U-shaped frame 14 is rotatable about the pivot axis 22. The middle region 52 and the lower end 31 of the first segment 30 meet to form a hub 43 at a mid-point 65 of the head end frame member 49. The hub 43 is positioned such that the axis 22 extends through the mid-point 65 of the head end frame 49.

The foot end frame member 51 of the rectangular frame 16 includes the first end 54, the second end 56 spaced apart from the first end 54, and a middle region 52 extending therebetween. The first end 54 is pivotably coupled to the gripper 45 and is configured to cooperate with the gripper 45 to rotate about the pivot axis 22. The second end 56 is pivotably coupled to the opposing gripper 47 and is configured to cooperate with the opposing gripper 47 to rotate about the pivot axis 22. This allows for the patient 13 to be moved between a variety of positions about the pivot axis 22 such that the patient 13 may be rotated by at least 180 degrees relative to the U-shaped frame 14. The middle region 52 is pivotably coupled to the lower end 39 of the second segment 32 of the U-shaped frame 14 such that the rectangular frame 16 is rotatable about the pivot axis 22 relative to the U-shaped frame 14. The middle region 52 and the lower end 39 of the second segment 32 meet to form a hub 71 at a mid-point 73 of the foot end frame member 51. The hub 71 is positioned such that the axis 22 extends through the mid-point 73 of the foot end frame 51. The hubs 43, 71 are formed to house the rotation mechanism 38, as will be discussed in further detail below.

Prior to any vertical movement or rotation of the patient 13, the sheets 58 are coupled to the system 12 at the sheet grippers 45, 47 of the rectangular frame 16. The sheet grippers 45, 47 are configured to releaseably couple the sheets 58 to form the pocket 59 between the sheets 58 and retain the patient 13 within the pocket 59 during movement of the patient 13. The grippers 45, 47 are configured to secure the patient 13 during both vertical and rotational movement of the patient 13 as shown in FIGS. 8-13. Prior to initially lowering the system 12 towards the mattress 10 and placing the rectangular frame 16 around the patient 13 on the mattress 10, the first sheet 64 is positioned between the patient support apparatus 10 and the patient 13. Illustratively, the patient 13 is positioned on the surface 19 of the mattress 10 such that the path of the system 12 to engagement with the surface region 19 of the patient support apparatus 10 is free from obstruction and allows the rectangular frame 16 to be placed on both lateral sides 53, 55 of the patient support apparatus 10, thereby flanking the patient 13 in preparation for rotation of the patient 13. Once the patient 13 is positioned substantially centered at the mid-point 86 of the patient support apparatus 10, the caregiver lowers the system 12 using the controller 57, as shown in FIG. 1. When the system 12 engages the first sheet 64, the patient 13 and the rectangular frame 16 are simultaneously located on top of the first sheet 64 and the surface region 19 of the patient support apparatus 10 so that the patient 13 is located within the space 84 formed by the rectangular frame 16 as shown in FIGS. 1 and 2.

After positioning the rectangular frame 16 as described above, the system 12 is configured to releasably couple the sheets 58 such that the patient 13 is located between the first sheet 64 and the second sheet 68. To secure the patient 13 and avoid any unwanted rotation or movement of the patient 13, the grippers 45, 47 are formed to include a sheet attachment mechanism 40 and a sheet tensioning mechanism 42. The sheet attachment mechanism 40 is configured to provide a means for releasably coupling the sheets 58 to the system 12. The sheet tensioning mechanism 42 is configured to provide a means for creating and maintaining tension in the sheets 58 such that the patient 13 is retained in the pocket 59 throughout movement and rotation of the patient 13 until the tensioning mechanism 42 is released.

Figure 26:
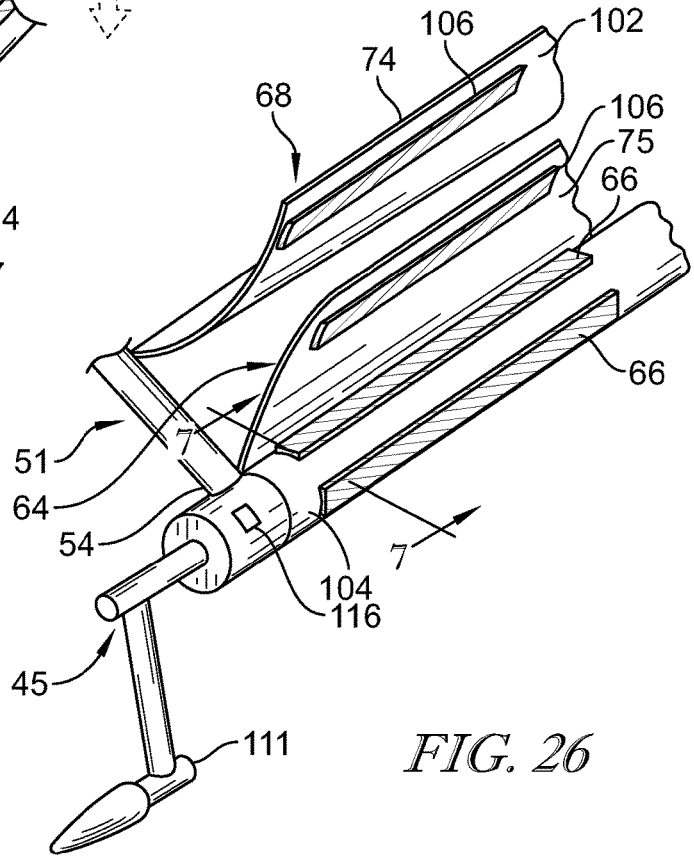
FIG. 26 is a perspective view of the sheet attachment mechanism showing that the sheet attachment mechanism includes a plurality of sheet strips coupled to the sheets and a plurality of gripper strips coupled to the grippers and configured to cooperate with the sheet strips to removeably couple the sheets to the grippers.
Figure 27:
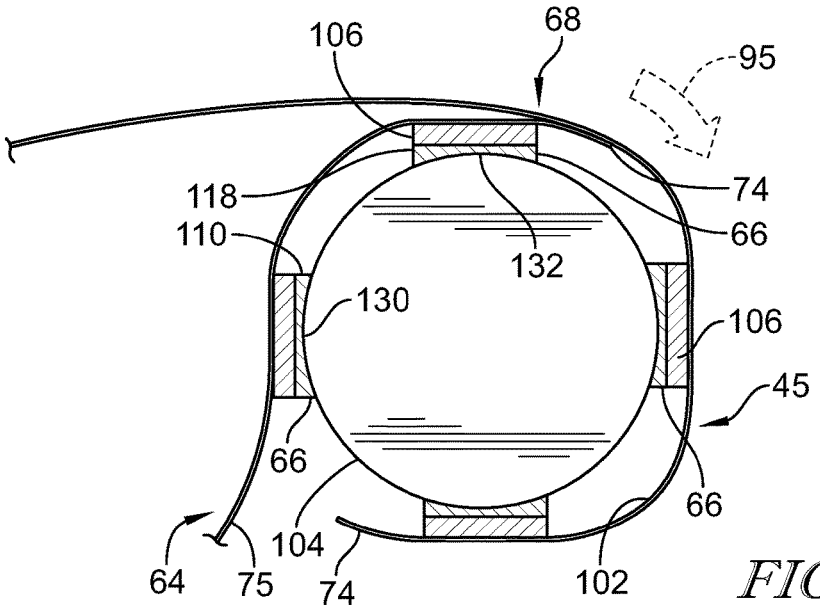
FIG. 27 is a cross-sectional view taken along line 7-7 of FIG. 26 of the sheet attachment mechanism after coupling of the sheet strips to the respective gripper strips and illustrating rotation of the gripper in the sheet-tensioning direction to avoid rotation of the grippers in the sheet-releasing direction.

The sheet attachment mechanism 40 may be coupled to the grippers 45, 47 such that the sheets 58 are positioned adjacent to and around an outer surface 104 of the grippers 45, 47 as shown in FIGS. 6, 26, and 27. The sheet attachment mechanism 40 includes a plurality of gripper strips 66 and a plurality of sheet strips 106. At least one gripper strip 66 is coupled to the outer surface 104 of each of the grippers 45, 47 and configured to align with one of the sheet strips 106 coupled to either the first sheet 64 or second sheet 68. Illustratively, the sheet strips 106 are coupled to a bottom surface 75, 102 of each of the sheets 64, 68, respectively. As such, the gripper strips 66 are configured to mate with the sheet strips 106 coupled to the sheets 58 to attach the sheets 58 to the system 12. Illustratively, the strips 106, 66 are formed from a hook and loop material such that the gripper strips 66 are formed from a material including a plurality of hooks and the sheet strips 106 are formed from a material including a plurality of loops, or vice versa. The two materials (hooks and loops) forming the gripper strips 66 and the sheet strips 106 are configured to mate with each other such that the two strips 66, 106 are removeably coupled to each other. It should be appreciated that either of the strips 66, 106 may be formed from either the hook material or loop material so long as the strips 66, 106 do not have material made out of the same material (i.e.: the gripper strips 66 and the sheet strips 106 formed from the hook material). Further, other attachment means known in the art are also contemplated herein.

The gripper strips 66 are substantially rectangular shaped and extend the length of each gripper 45, 47 between the head end 69 and the foot end 62 of the gripper 45, 47. It should be appreciated that the gripper strips 66 may be formed as a plethora of other shapes known to those in the art. The gripper strips 66 are formed from a resiliently adhesive material, as shown in FIGS. 26 and 27 and configured to couple to the sheet strips 106. Illustratively, the outer surface 104 of each gripper 45, 47 is coupled to at least four gripper strips 66 spaced apart equidistant from each other as illustrated in FIG. 27. The gripper strips 66 extend substantially parallel to the longitudinal axis 22 of the patient support apparatus 10 and are configured to rotate thereabout.

The sheet strips 106 are coupled to the bottom surface 75, 102 of the sheets 58 at a first lateral edge 74 of each of the sheets 64, 68. Illustratively, each of the sheets 64, 68 are coupled to at least two sheet strips 106 spaced apart from each other and positioned at both the first lateral edge 74 and a second lateral edge 76 of each sheet 64, 68. The sheet strips 106 are sized to extend the vertical length of each sheet 64, 68 and run substantially parallel to the longitudinal axis 22 in a substantially similar manner to the gripper strips 66. Illustratively, each sheet 64, 68 is coupled to two pairs of two sheet strips 106 at each lateral edge 74, 76 of the sheet 64, 68 such that the two sheet strips 106 within each pair are spaced apart from each other at a distance equal to that of the distance between the gripper strips 66 positioned on the grippers 45, 47. Illustratively, the two pairs of sheet strips 106 are located on the bottom surface 75 of the first sheet 64 and positioned at both of the lateral edges 74, 76 of the sheet 64. As such, the sheet 64 illustratively includes at least four sheet strips 106 having two positioned at the first lateral edge 74 and two positioned at the second lateral edge 76. The second sheet 68 is coupled to two pairs of sheet strips 106 in substantially the same manner as the first sheet 64 discussed above.

Each sheet strip 106 is configured to engage any of the gripper strips 66, but, illustratively, each of the sheet strips 106 couples to a respective gripper strip 66 as shown in FIG. 27. Engagement of the gripper strips 66 by the sheet strips 106 removeably couples the sheets 64, 68 to the system 12 as shown in FIGS. 5, 6, and 27. As such, the sheet strips 106 are configured to be positioned over the gripper strips 66 and removeably couple to each other 106, 66 upon application of a downward force upon the strips 66, 106 by the caregiver. Further, the sheet strips 106 are sized and shaped substantially similar to the gripper strips 66 such that when the strips 106, 66 are coupled to each other, the sheet strips 106 cover a substantial portion of the gripper strips 66. The gripper strips 66 and sheet strips 106 are coupled to the grippers 45, 47 and the sheets 64, 68, respectively, using a method of adhesion such as glue, bonding, and/or other coupling means known in the art.

The sheet attachment mechanism 40 allows a caregiver to removably couple the sheets 58 to the grippers 45, 47 to prepare the patient 13 for movement and/or rotation as shown in FIGS. 3-6. After positioning the rectangular frame 16 around the patient 13 such that the patient 13 is positioned in the space 84 formed by the rectangular frame 16 as shown in FIGS. 1-3, the caregiver places the first sheet 64 on top of the grippers 45, 47 such that the sheet strips 106 are positioned substantially on top of and adjacent to the gripper strips 66, as shown in FIG. 4. Illustratively, the two sheet strips 106 of the first sheet 64 are placed on top of a first gripper strip 110 and a second gripper strip 118. The first gripper strip 110 is positioned on the outer surface 104 of each of the grippers 45, 47 at an inner lateral position 130 and the second gripper strip 118 is positioned at an upper position 132 as shown in FIG. 27. To do so, the caregiver pulls the first lateral edge 74 of the first sheet 64 upwardly towards the ceiling lift 26 and through the space 84 created between the grippers 45, 47 such that the first lateral edge 74 of the first sheet 64 is positioned between a first side 96 of the patient 13 and the gripper 45. The caregiver further positions the first lateral edge 74 of the first sheet 64 on top of the gripper 45 such that the first lateral edge 74 of the first sheet 64 drapes over the gripper 45 and extends downwardly towards the mattress 10, as shown in FIG. 4. The caregiver repeats the process of positioning the first sheet 64 on top of the opposite gripper 47 but uses instead the second lateral edge 76 of the first sheet 64 in substantially the same manner as discussed above concerning the placement of the first lateral edge 74 of the first sheet 64 over the gripper 45. Differing from the aforementioned manner, the second lateral edge 76 of the first sheet 64 is configured to extend through the space 84 created between the grippers 45, 47 such that the second lateral edge 76 of the first sheet 64 is located between a second lateral side 98 of the patient 13 and the gripper 47. After extending the second lateral edge 76 of the first sheet 64 through the space 84, the caregiver places the second side edge 76 on top of the gripper 47, as shown in FIG. 4. It should be appreciated that the caregiver may place the second side edge 76 of the first sheet 64 over the gripper 47 before placing the first side edge 74 over the gripper 45 as deemed appropriate by the caregiver.

After coupling both of the sheets 58 to the grippers 45, 47 the pocket 59 is formed. The sheets 64, 68, the grippers 45, 47, and the sheet attachment mechanism 40 cooperate to form the pocket 59 between the sheets 64, 68 wherein the patient 13 is located. The pocket 59 is configured to engage and retain the patient 13 positioned on the patient support apparatus 10 between the sheets 64, 68 such that a majority of the patient 13 is located between the sheets 64, 68. Illustratively, the patient's head 35 and feet 37 extend from the pocket 59 to facilitate comfort of the patient 13 as shown in FIG. 7. Additional embodiments of the sheet attachment mechanism 40 are contemplated herein and discussed below.

As explained above, to form the pocket 59 between the first sheet 64 and the second sheet 68, the sheet attachment mechanism 40 is configured to engage both of the sheets simultaneously 64, 68 as shown in FIG. 5. As such, the first gripper 45 is formed to include the sheet attachment mechanism 40. The sheet attachment mechanism 40 is configured to engage the first side edge 74 of the first and second sheets 68. Further, the second gripper 47 is formed to include a substantially similar sheet attachment mechanism 40 configured to engage the second side edge 76 of the first sheet 64 and second sheet 68. Illustratively, the sheet attachment mechanism 40 is found in both the first gripper 45 and the second gripper 47. Further, the sheet attachment mechanism 40 may be included in just one of the grippers 45, 47 such that the side edges 74, 76 of the sheets 64, 68 are removeably coupled and simultaneously engaged by the single sheet attachment mechanism 40 coupled to one of the grippers 45, 47. Additional embodiments of the sheet attachment mechanism 40 may be configured to couple the rectangular frame 16 to only the first sheet 64 or only the second sheet 68. Illustratively, both sheets 64, 68 are configured to be removeably coupled to the sheet attachment mechanism 40 formed within or coupled to the grippers 45, 47.

After aligning and coupling the sheet strips 106 to the gripper strips 66, the caregiver rotates the grippers 45, 47 about the longitudinal axis 22 in a sheet-tensioning direction 95 away from the patient support apparatus 10 to create tension in the sheets 64, 68 as shown in FIG. 27. The caregiver continues to rotate the grippers 45, 47 until at least a slight tension is created in the sheets 64, 68 such that the sheets 64, 68 are removeably coupled to the grippers 45, 47 in a secured manner. As such, the grippers 45, 47 are configured to create tension in the sheets 64, 68 via rotation about the longitudinal axis 22. The increased tension is formed using a sheet tensioning mechanism 42 located/formed within each of the grippers 45, 47 such that each of the grippers 45, 47, illustratively, has a sheet tensioning mechanism 42 independent of the sheet tensioning mechanism 42 of the other gripper 45, 47. Therefore, to create the tension, the caregiver actuates at least one of the sheet tensioning mechanism 42 located within one of the grippers 45, 47. Illustratively, both grippers 45, 47 are actuated by the caregiver so that tension is created at both lateral sides 74, 76 of the sheets 64, 68. As shown in FIGS. 5 and 6 and discussed above, the sheet tensioning mechanism 42 is configured to maintain the pocket 59 formed between the sheets 64, 68. The pocket 59 retains the patient 13 between the sheets 64, 68 so that the patient 13 may be lifted upwardly away from the patient support apparatus 10 and rotated about the longitudinal axis 22 without substantial movement of the patient 13 within the pocket 59. Therefore, increasing the tension of the sheets 64, 68 which form the pocket 59 thereby creates tension in the pocket 59 and maintains the patient 13 in the pocket 59.

Referring to FIGS. 21-24, the sheet tensioning mechanism 42 is configured to rotate the grippers 45, 47 upon actuation by the caregiver to create additional tension in the sheets 64, 68 by wrapping the sheets 64, 68 around the grippers 45, 47 and maintaining such tension throughout rotation of the patient 13. Illustratively, the caregiver actuates the sheet tensioning mechanism 42 after the sheets 64, 68 have been removeably coupled to the grippers 45, 47 via the sheet attachment mechanism 40. The sheet tensioning mechanism 42 includes a sheet-tensioning mechanism housing 70 and a ratchet assembly 77. The sheet-tensioning mechanism housing 70 is formed to house a majority of the ratchet assembly 77 and is illustratively positioned at the lower end 67 of each of the grippers 45, 47 such that each gripper 45, 47 is configured to rotate independently of the other. The ratchet assembly 77 is positioned within the housing 70 and configured to act as a means to rotate the respective gripper 45, 47 and thereby rotate the sheets 64, 68 removeably coupled to the gripper 45, 47.

Figure 21:
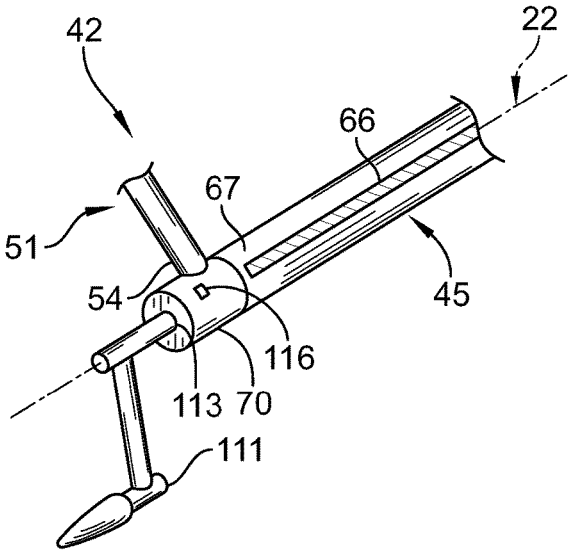
FIG. 21 is a perspective view of a sheet tensioning mechanism showing a manual actuator coupled to the gripper and configured to created tension in the sheets coupled to the grippers thereby further defining the pocket around the patient.
Figure 22:
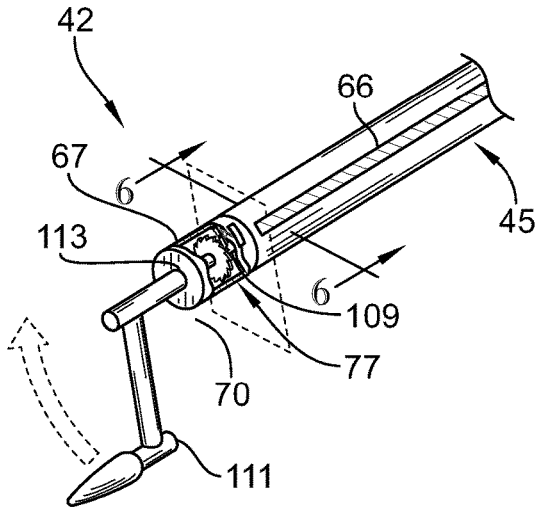
FIG. 22 is a perspective view similar to FIG. 21 of the sheet tensioning mechanism having a section broken away and showing that the sheet tensioning mechanism includes a housing coupled to the sheet grippers and a ratchet assembly located within the housing and configured to create tension in the sheets.
Figure 23:
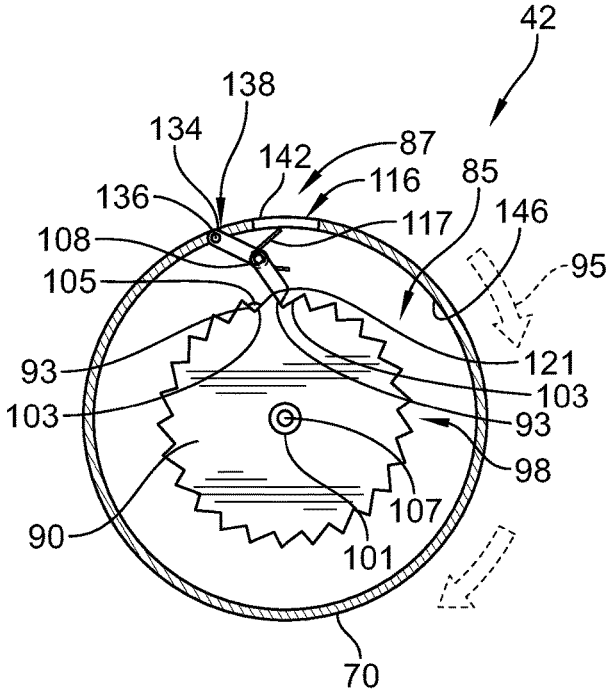
FIG. 23 is a cross-sectional view taken along line 6-6 of FIG. 22 of the sheet tensioning mechanism and showing the ratchet assembly in an engaged state such that rotation of the gripper is blocked in a sheet-releasing direction.

As shown in FIGS. 21 and 22, the housing 70 is fixedly coupled to the lower ends 67 of each of the grippers 45, 47 such that each of the grippers 45, 47 extend parallel to the longitudinal axis 22. Each housing 70 is spaced apart from the other housing 70 and fixedly coupled to the ends 54, 56 of the foot end frame member 51. Illustratively, at least a portion of the sheet tensioning mechanism 42 is located within the sheet-tensioning mechanism housing 70. The housing 70 is formed to include an actuator 111 extending through an opening 113 of the housing 70. Illustratively, the actuator 111 is formed as a handle. To manually create tension in the sheets 64, 68, the caregiver actuates the handle 111 by, illustratively, rotating the handle 111 about the rotation axis 22 to overcome the bias of a biasing member 117 coupled to the handle 111, as shown in FIGS. 22 and 23. Overcoming the bias allows for movement of the ratchet assembly 77 and rotation of the gripper 45, 47 about the rotation axis 22. Each of the grippers 45, 47 is coupled to the respective sheet-tensioning mechanism housing 70 and is configured to rotate in response to the actuation of the actuator 111 by a caregiver. Illustratively, the handle 111 extends away from the patient support apparatus 10 such that it is accessible by the caregiver.

Figure 24:
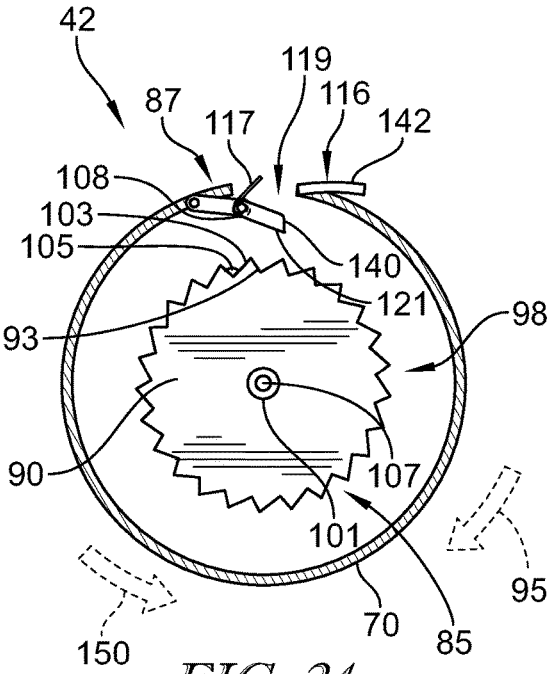
FIG. 24 is a cross-sectional view taken along line 6-6 of FIG. 22 of the sheet tensioning mechanism after actuation of a release mechanism included in the ratchet assembly and showing the ratchet assembly in a disengaged state such that the gripper is free to rotate in either the sheet-releasing direction or a sheet-tensioning direction.

The ratchet assembly 77 selectively controls the rotation of the grippers 45, 47 relative to the longitudinal axis 22 as shown in FIGS. 23 and 24. The ratchet assembly 77 is configured to move between an engaged state (shown in FIG. 23) and a disengaged state (shown in FIG. 24). When in the engaged state, the assembly 77 allows for rotation of the gripper 45, 47 only in a sheet-tensioning direction 95 and rotation of the gripper 45, 47 in a sheet-releasing direction 150 is blocked. Illustratively, the sheet-releasing direction 150 is the direction opposite the sheet-tensioning direction 95 as shown in FIG. 24. As the assembly 77 is moved into the disengaged state, the ratchet assembly 77 permits rotation of the grippers 45, 47 in both the sheet-tensioning 95 and the sheet-releasing direction 150 to allow for unwrapping/unwinding of the sheets 64, 68 from the grippers 45, 47. The ratchet assembly 77 includes a gear 85 coupled to and configured to be actuated by the handle 111 and a ratchet release mechanism 87 configured to engage the gear 85 and control rotation of the grippers 45, 47.

As shown in FIGS. 23 and 24, the gear 85 is formed as a wheel 90 having a plurality of teeth 98 projecting radially outwardly from the circumference of the gear 85. Each of the teeth 98 include a straight surface 93 that lies generally in a plane extending radially from a center 101 of the wheel 90. Each of the teeth 98 includes an angled surface 103 forming an acute angle 105 with the straight surface 93. The wheel 90 is formed to include an opening 107 at its center 101 to receive a rotation rod 109 therein. The rotation rod 109 is coupled to the handle 111 and extends longitudinally along the axis 22 through the gear 85 and the gripper 45, 47 and is coupled to the gear 85 and the gripper 45, 47 to translate rotation of the handle 111 to the gripper 45, 47. Illustratively, when the ratchet release mechanism 87 is in the locked position (as shown in FIG. 23), the ratchet release 87 permits rotation of the gear 85 and the rotation rod 109 in the sheet-tensioning direction 95 but inhibits movement in the sheet-releasing direction 150. When in the unlocked position (as shown in FIG. 24), the ratchet release mechanism 87 allows for movement of the gear 85 and the rotation rod 109 in either direction 95, 150.

The ratchet release mechanism 87 is configured to be actuated by the caregiver to allow the gear 85 to freely rotate in either direction 95, 150 about the axis 22 and, as such, release the sheets 64, 68 from the grippers 45, 47. When not actuated by the caregiver, the ratchet release mechanism 87 is biased towards and engaged with the teeth 98 of the gear 85 to block free rotation about the rotation axis 22 and maintain the tension created in the sheets 64, 68 by the sheet tensioning mechanism 42. The ratchet release mechanism 87 includes a release 116 formed in the housing 70, a pawl 108 located within the gripper 45, 47, and a biasing member 117 coupled to the pawl 108 and configured to engage the release 116 as shown in FIGS. 23 and 24. The release 116 is formed as an aperture 119 in the housing 70 and is positioned such that the caregiver may access the release 116 in order to move the pawl 108 between positions. The pawl 108 is positioned within the housing 70 and is configured to move between a locked position and an unlocked position. The biasing member 117 is coupled to and configured to bias the pawl 108 into engagement with the teeth 98 of the gear 85.

The pawl 108 is coupled to the housing 70, as shown in FIGS. 23 and 24. Illustratively, the pawl 108 is formed to include an aperture 134 at a first end 138 that is configured to receive a pawl rotation rod 136. The pawl rotation rod 136 is coupled to an inner wall 146 of the housing 70 and the pawl 108 is configured to rotate about the pawl rotation rod 136. The pawl 108 extends inwardly towards the center 101 of the wheel 90 and terminates in a second end 140 sized to engage one of the teeth 98 of the gear 85. The pawl 108 is formed to include an engagement surface 121 at the second end 140 that is configured to engage the straight surface 93 of one of the teeth 98. As such, when the pawl 108 engages the tooth 98, ratchet release mechanism 87 is in the locked position, and when the ratchet release mechanism 87 is in the unlocked position, the pawl 108 does not engage the tooth 98. The pawl 108 and the biasing member 117 cooperate to maintain the pawl 108 in the locked position at all times until/unless the release 116 is actuated by the caregiver.

The biasing member 117 is illustratively a torsion or rotary spring and is positioned within the housing 70 such that it is coupled to the pawl 108 and configured to engage the release 116 when the ratchet release mechanism 87 is in the locked position. As shown in FIG. 23, the biasing member 117 is formed to provide a biasing force against the pawl 108 using the force created at the engagement of the release 116 and the biasing member 117. The biasing member 117 is configured to bias the gear 85 such that the gear 85 is blocked from rotating in the sheet-releasing direction. The biasing force of the biasing member 117 may be overcome by actuation of the release 116 by the caregiver as shown in FIG. 24. As such, upon actuation of the release 116, the gripper 45, 47 automatically rotates in the sheet-releasing direction and the pawl 108 is free from contact with any teeth 98. Upon removal of the actuation of the release 116, the pawl 108 moves back into engagement with the teeth 98 of the gear 85 and the aforementioned automatic rotation of the gripper 45, 47 is once again blocked by the pawl 108. Therefore, to create tension in the sheets 64, 68 such that the sheets 64, 68 remain coupled to the grippers 45, 47 during rotation of the patient 13, an actuation force is applied to the handle 111 such that the handle 111 rotates about the rotation axis 22 in the sheet-tensioning direction 95 thereby moving the rotation rod 109 and the gear 85 in the same direction as the handle 111. This rotation is further translated to the grippers 45, 47 as the caregiver rotates the handle 111 about the axis 22. The rotation of the grippers 45, 47 creates tension in the sheets 64, 68 by wrapping the sheet 64, 68 around the grippers 45, 47 and blocking the release of the tension when the ratchet release mechanism 87 is in the locked position via the interaction of the biasing member 117, the pawl 108, and the release 116.

The release 116 is formed in and extends through an outer surface 104 of each of the grippers 45, 47 and includes a removable upper surface 142 as shown in FIGS. 23 and 24. The upper surface 142 is configured to be engaged by the biasing member 117 when the ratchet release mechanism 87 is in the locked position. Due to the engagement of the biasing member 117 and the removable surface 142, the pawl 108 is forced downwardly toward the teeth 98 such that the engagement surface 121 of the pawl 108 engages the straight surface 93 of one of the teeth 98. As such, the pawl 108 is configured to remain in engagement with the gear 85 throughout rotation of the handle 111 such that the gear 85 is blocked from rotating in the sheet-releasing direction.

To move the ratchet release mechanism 87 between the locked and unlocked positions, the caregiver engages the release 116 to move the pawl 108 by moving the release 116 out of engagement with the biasing member 117. The release 116 may be embodied as a sliding door, rotating door, latch, and/or other release surfaces known in the art. When the release 116 is moved out of engagement, the biasing member 117 no longer applies a biasing force upon the pawl 108. As such, the ratchet release mechanism 87 in the unlocked position and the pawl 108 is free to move out of engagement with the tooth 98 to allow the gear 85 to rotate in either the sheet-releasing direction as the gear 85 or the sheet-tensioning direction. When in the ratchet release mechanism 87 is in the unlocked position, the rotation rod 109, the grippers 45, 47 and the handle 111 are also free to rotate about the axis 22 in either direction to either release or create tension in the sheets 64, 68. The caregiver may wish to permit such rotation of the grippers 45, 47 to remove tension created in the sheets 64, 68 prior to removing the sheets 64, 68 from the grippers 45, 47. To move the ratchet release mechanism 87 back into the locked position, the caregiver removes the actuation force from the release 116 by placing the upper surface 142 back into engagement with the biasing member 117 to create/apply a biasing force on the pawl 108. As such, the pawl 108 moves back into engagement with one of the teeth 98 and thereby blocks rotation of the grippers 45, 47 in the sheet-releasing direction. Additional embodiments of the sheet tensioning mechanism 42 are contemplated herein and discussed below.

Once the sheets 64, 68 are coupled to the grippers 45, 47 and tension has been created in the sheets 64, 68, the patient 13 is prepared to be lifted upwardly away from the patient support apparatus 10 in preparation for the rotation of the patient 13 from a supine position to a prone position or vice versa. As shown in FIGS. 8 and 9, the patient 13 is located within the pocket 59 created between the sheets 64, 68 and moved upwardly away from the patient support apparatus 10 and along the rotation axis 22. This upward movement creates the distance 80 between the patient 13 and the patient support apparatus 10 such that the patient 13 and the patient support apparatus 10 are spaced apart from each other. The distance 80 allows for the patient turning system 12 to freely rotate the patient 13 about the rotation axis 22 as shown in FIGS. 10 and 11. An appropriate/safe distance 80 may be determined by the caregiver using the lift controller/pendent 57 formed to include a user interface 126. The user interface 126 is configured to allow the caregiver to provide various inputs 82 pertinent to the rotation of the patient 13 such as the patient's weight and/or height as well the patient's/caregiver's desired position/location of the patient 13. The appropriate distance 80 may be determined by the lift controller 57 based on an amalgamation of these inputs 82 and confirmed by the caregiver, by the caregiver alone, by an automatic pre-programmed algorithm, and/or some combination thereof.

As shown in FIG. 10, the lift controller 57 is in electronic communication with the lift 26, and is configured to receive user inputs 82. The controller 57 may include a plurality of buttons (not shown) for inputting patient information and/or for controlling operation of the lift 26 and may further include a display screen 128. Particularly, the controller 57 allows the caregiver to adjust the distance 80 between the patient 13 and the patient support apparatus 10. Specifically, in some embodiments, the controller 57 may include a patient information input panel and a lateral rotation panel. The controller 57 is configured to control the vertical operation of the lift 26. Illustratively, the controller 57 is coupled for electronic communication with the lift 26 to control the speed by which the patient 13 moves upwardly. Illustratively, the controller 57 is formed as a cell phone, tablet, or other portable device.

The lift controller 57 comprises at least one processor (not shown) and at least one memory device (now shown). The memory device stores instructions for execution by the processor. The controller 57 receives information from the user interface 126, via electronic communication, as inputs 82 to assist the processor in executing the instructions stored in memory device, and outputs signals to the lift 26, to a lift motor 144, and/or to other components of the lift 26 to control the operation of the lift 26. Illustratively, the controller 57 is configured to wirelessly communicate with the lift 26 and the user interface 126.

After the controller 57 and/or the caregiver determine the clearance distance 80 necessary for rotation of the patient 13, the caregiver actuates the lift 26 and raises the patient 13 upwardly towards the ceiling lift 26 until reaching the desired distance 80 as shown in FIGS. 8-10. As the patient 13 reaches the desired vertical distance 80 from the patient support apparatus 10, the lift frame 18 is configured to be unlocked such that rotation of the patient 13 and the lift frame 18 about the longitudinal axis 22 may occur. To unlock the lift frame 18, the caregiver actuates a rotation locking mechanism 115 as shown in FIGS. 1, 2, and 18-20. The rotation locking mechanism 115 is configured to maintain the lift frame 18 in the locked position until actuated by a caregiver. Illustratively, the rotation locking mechanism 115 is integrated into the rotation mechanism 38 and is shaped as a latch. The latch 115 is configured to be manually actuated by the caregiver once the patient 13 reaches the desired vertical height 80. Illustratively, the rotation locking mechanism 115 is coupled to only one of the rotation mechanisms 38 so that the latch 115 is located at either the head end frame 49 or the foot end frame 51. In other embodiments, the latch 115 may also be coupled to both the head end frame 49 and the foot end frame 51. Further, other known locking mechanisms in the art are also contemplated herein.

Figure 17:
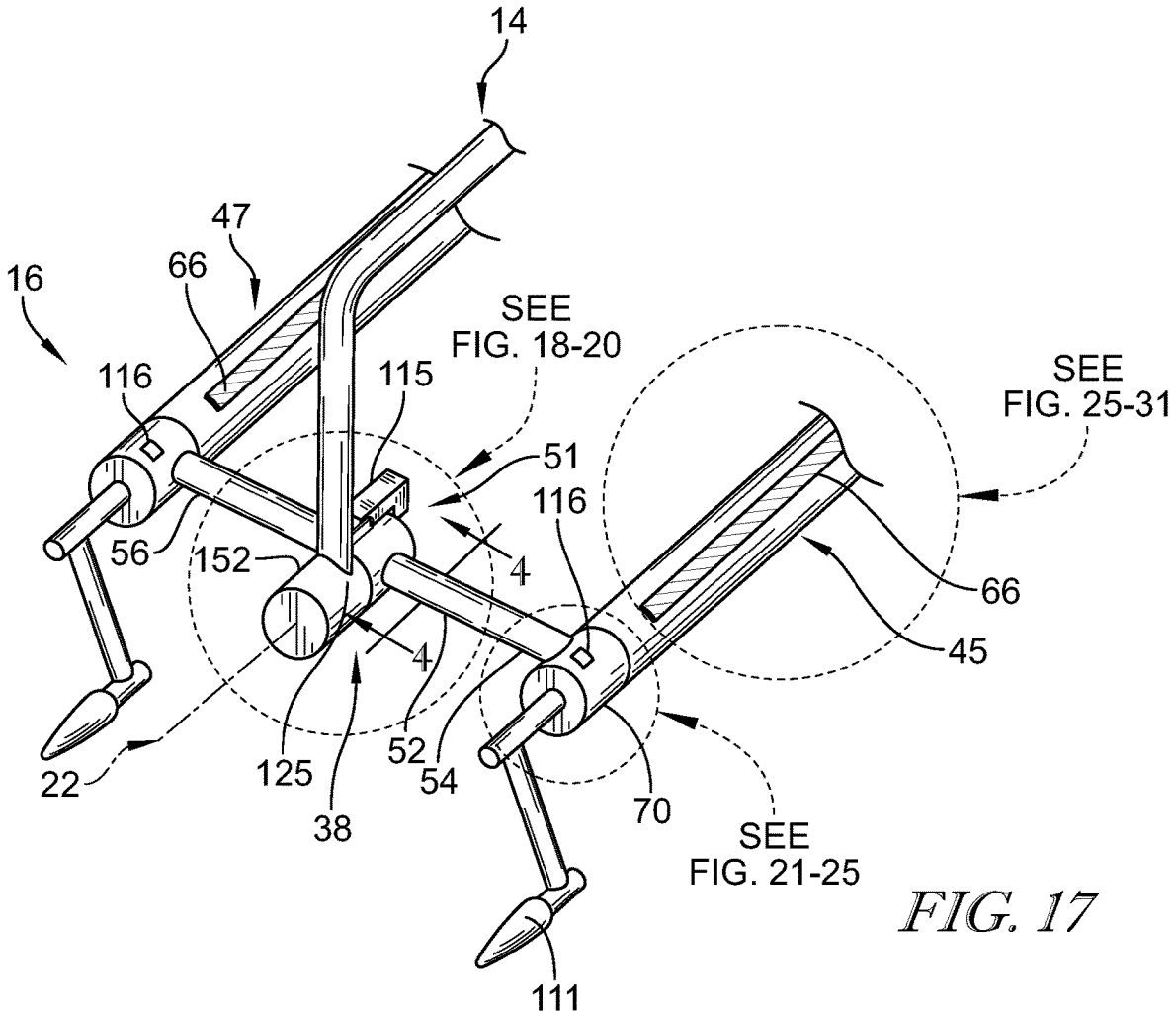
FIG. 17 is a perspective view of a foot end member of the rectangular frame showing a sheet attachment mechanism, a sheet tensioning mechanism, a rotation locking system, and a rotation mechanism.
Figure 19:
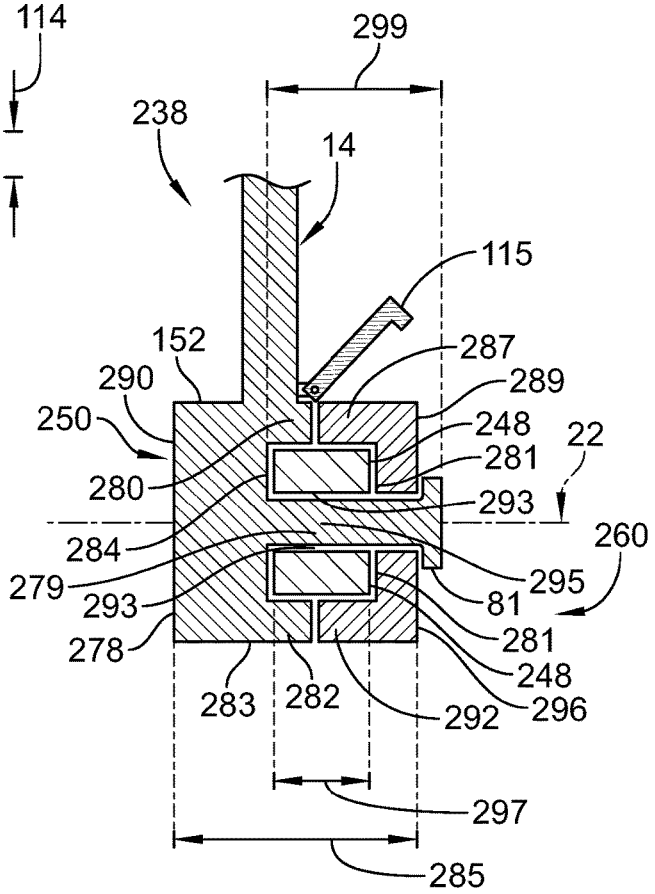
FIG. 19 is a cross-sectional view of a second embodiment of the rotation mechanism including a rotational damper positioned between the rotation anchor and the rotation anchor receiver.

Once the rotation locking mechanism 115 is in the unlocked position, as shown in FIG. 19, the rectangular frame 16 is free to rotate about the rotation axis 22. To do so, the rotation mechanism 38 is actuated. The rotation mechanism 38 is configured to move between a locked state, as shown in FIGS. 8 and 9, and an unlocked state, as shown in FIGS. 10 and 11 in response to actuation of the rotation mechanism 38. The rotation mechanism 38 allows for rotation of the patient 13 about the longitudinal axis 22 of the patent support apparatus 10 when the rotation mechanism 38 is in the unlocked state and blocks rotation of the patient 13 when in the locked state. The rotation mechanism 38 is coupled to the U-shaped frame 14 at an upper surface 152 of the rotation mechanism 38 and further coupled to the rectangular frame 16, as shown in FIG. 17. Illustratively, there are two rotation mechanisms 38 coupled to the rectangular frame 16. One of the rotation mechanisms 38 is positioned at a mid-point 125 located centrally in the middle region 52 of the head end frame member 49, and a second of the rotation mechanisms 38 is positioned at the mid-point 125 located centrally in the middle region 52 of the foot end frame member 51. Illustratively, the rotation mechanisms 38 are located at substantially the same location at the head end frame 49 and the foot end frame 51. As such, movement of the rotation mechanism 38 about the axis 22 is conveyed to the rectangular frame 16. The head and foot end frame members 49, 51 are configured to communicate the rotational movement of the rotation mechanism 38 to the grippers 45, 47 via the sheet-tensioning mechanism housing 70 such that the grippers 45, 47 are configured to rotate in response to movement of the head and foot end frame members 49, 51.

Figure 18:
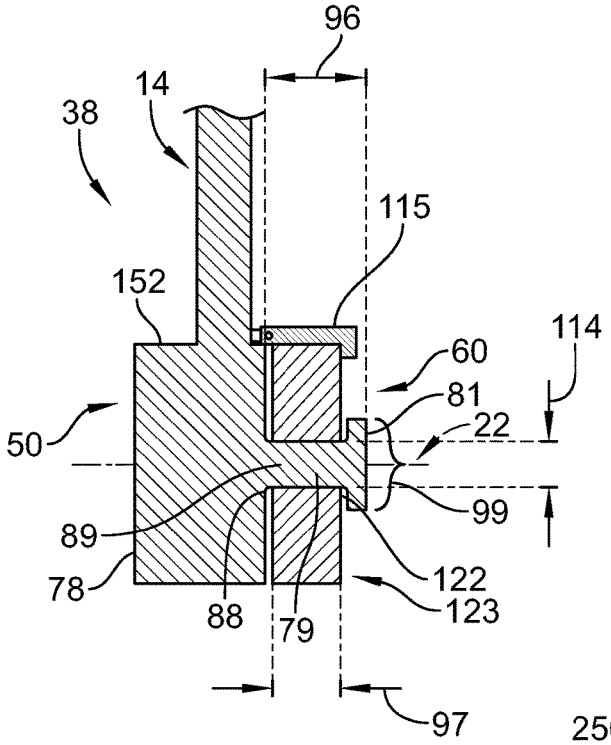
FIG. 18 is a cross-sectional view taken along line 4-4 of FIG. 17 of the rotation mechanism showing a rotation anchor coupled to a rotation anchor receiver.

The rotation mechanism 38 includes a rotation anchor 50 and a rotation anchor receiver 60 moveably coupled to each other, as shown in FIG. 18. The rotation anchor 50 is coupled to the U-shaped frame 14 and remains in substantially the same location throughout the rotation of the patient 13. The rotation anchor 50 is further coupled to the rotation anchor receiver 60 such that the rotation anchor 50 extends into an aperture 122 formed in the rotation anchor receiver 60. The rotation anchor receiver 60 is coupled to the head and foot end frames 49, 51 of the rectangular frame 16 and is configured to move with the rectangular frame 16 upon rotation of the patient 13 about the axis 22. This allows for the rotation anchor 50 to maintain the position and stability of the patient 13 positioned between the sheets 64, 68 while the rotation anchor receiver 60 rotates about the anchor 50 along the axis 22.

As illustrated in FIG. 18, the rotation anchor 50 is formed to include an anchor body 78, an anchor extension 79, and an anchor retainer 81. The rotation anchor body 78 is coupled to the respective first or second segment 30, 32 of the u-shaped frame 14 at an outer, upper surface 83 of the rotation anchor body 78. The anchor extension 79 is formed to extend substantially along the rotation axis 22 from an inner surface 88 of the anchor body 78 to the anchor retainer 81. Illustratively, the anchor extension 79 is positioned at a substantially, centrally located mid-point 89 of the inner surface 88. The extension 79 is sized such that the length 96 of the extension 79 is greater that the length 97 of the rotation anchor receiver 60 and is formed to include the anchor retainer 81 at an outer end 91 of the extension 79. The retainer 81 is formed to extend from the extension 79 in a substantially vertical manner in relation to the axis 22 and is configured to maintain the rotational coupling of the rotation anchor 50 and the rotation anchor receiver 60. The retainer 81 is sized such that the height 99 of the retainer 81 is greater than the height 114 of the aperture 122 formed in the anchor receiver 60. As such, the rotation anchor body 78 is configured to remain at a substantially consistent position along the axis 22.

Figure 20:
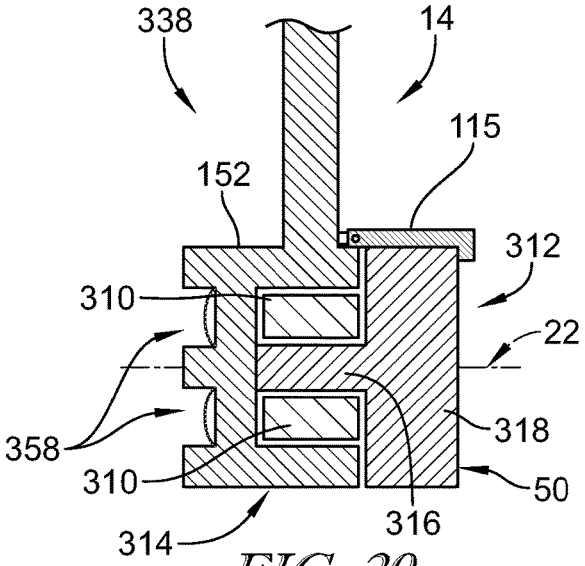
FIG. 20 is a cross-sectional view of a third embodiment of the rotation mechanism showing a rotation actuator, a rotation anchor mover coupled to the rotation actuator, and a rotation anchor.

The anchor receiver 60 is formed to include a rotating member 123 having the anchor receiving aperture 122 formed therein. Illustratively, the aperture 122 is located at a substantially central point 124 of the anchor receiver 60 such that the rotating member 123 surrounds the aperture 122 on all sides of the aperture 122. The aperture 122 receives and engages the anchor extension 79 throughout the rotation of the patient 13. The rotating member 123 is configured to rotate about the anchor extension 79 positioned within the aperture 122 when the rotation locking mechanism 115 is in an unlocked position, as shown in FIG. 19. When unlocked, the rotating member 123 is configured to move with the head and foot end frames 49, 51 thereby rotating the rectangular frame 16 and the patient 13 positioned therein about the axis 22. When locked, as shown in FIGS. 18 and 20, the rotating member 123 is blocked from rotation such that the entire rectangular frame 16 and the patient 13 are also blocked from rotation. Additional embodiments of the rotation mechanism 38 are contemplated herein and discussed below.

As such, when locked, the rotation mechanism 38 does not allow for rotation of the patient turning system 12. Upon moving the rotation mechanism 38 into an unlocked state via the locking mechanism 115, the rotation mechanism 38 is prepared to be actuated by the caregiver to begin rotating the patient 13 about the longitudinal axis 22 as shown in FIGS. 10 and 11. Actuation of the rotation mechanism 38 may be provided by the caregiver manually or electrically via the controller 57 as determined by the user input 82. Further, the controller 57 may provide an actuator force automatically in view of an algorithm programmed into the controller 57 and configured to unlock the rotation mechanism 38 when the patient 13 reaches a vertical distance 80 above the patient support apparatus 10 as determined by the programmed algorithm. To determine when such a distance 80 is reached, a plurality of sensors (not shown) may be used.

Upon actuation of the rotation mechanism 38, the patient 13, the sheets 64, 68, and the rectangular frame 16 are configured to rotate about the longitudinal axis 22 as shown in FIGS. 10 and 11 and discussed in detail above. The speed by which the patient 13 rotates may be controlled manually by the caregiver, mechanically (i.e.: a rotation damper 348), or electronically (i.e.: an actuator(s) 458). Similarly, too can the ceasing of rotational movement of the patient 13 be accomplished manually by the caregiver, mechanically, electronically, or some combination thereof.

Once the patient 13 has reached the desired rotational position along the longitudinal axis 22, the caregiver stops rotation of the patient turning system 12 such that the patient's rotational movement ceases and the patient 13 remains spaced apart from the patient support apparatus 10. The patient turning system 12 is configured to rotate the patient about the axis 22 and halt rotation of the patient 13 at any angle along the axis 22. The patient turning system 12 is further configured to move the patient 13 downwardly away from the lift 26 to return the patient 13 on top of the mattress 10 as shown in FIGS. 14 and 15. Prior to lowering the patient 13 to assure that unwanted rotation of the patient 13 does not occur, the caregiver returns the rotation mechanism 38 to the locked state using the locking mechanism 115 once the patient 13 is positioned at the desired angle. Illustratively, the patient 13 is rotated 180 degrees about the axis 22 such that the patient 13 is positioned in a prone position as shown in FIGS. 12 and 13. In doing so, further rotation of the patient 13 is prevented and the patient 13 may then be lowered downwardly towards the patient support apparatus 10 via the extension of the strap 17 of the ceiling lift 26. Extension of the strap 17 is stopped once the patient 13 engages the surface region 19 of the mattress 10 such that the patient 13 is positioned in the caregiver's desired location on top of the mattress 10 and in the desired angle of rotation, as shown in FIGS. 14 and 15. The locking mechanism 115 remains in the locked position to continue to secure the patient 13 in the pocket 59 until the sheet tensioning mechanism 42 is released and the sheets 64, 68 are free to be removed from engagement with the grippers 45, 47.

After the caregiver situates the patient 13 on the patient support apparatus 10 in the desired position as shown in FIGS. 14 and 15, the release 87 of the sheet tensioning mechanism 42 is configured to be actuated by the caregiver such that the tension created in the sheets 64, 68 by the sheet tensioning mechanism 42 is released. This allows for rotation of the grippers 45, 47 and the sheets 64, 68 in the sheet-releasing direction 150 as shown in FIG. 24. The sheet-releasing direction 150 allows for the sheets 64, 68 to be unwound from around the outer surface 104 of the grippers 45, 47 and removes the tension in the sheets 64, 68. The loss of tension in the sheets 64, 68 results in the collapse of the pocket 59. Yet, the pocket 59 continues to be formed by the sheets 64, 68 for as long as the sheets 64, 68 remain coupled to the grippers 45, 47. As such, once the tension is released from the sheets 64, 68, the sheets 64, 68 are configured to be decoupled from the sheet attachment mechanism 40 coupled to the grippers 45, 47. The first sheet 64 is further configured to be entirely removed from the system 12. Illustratively, this allows for the replacement of a soiled first sheet 64 with a clean first sheet 64 as well as the completion of a variety of other patient care needs/desires necessitating rotation of the patient 13 or access to the first sheet 64. Further, the patient 13 is located such that he/she/they are properly positioned for a variety of procedures/treatments/adjustments. As such, the patient turning system 12 is configured to be removed from engagement with the patient support apparatus 10 and the second sheet 68 once the patient 13 is positioned at desired location on the mattress 10 and angle of rotation about the axis 22, the sheet tensioning mechanism 42 has been released, and the sheets have been decoupled from the sheet attachment mechanism 40. The system 12 may then be removed from the mattress 10 and the sheets 64, 68 such that only the patient 13 and at least one of the sheets 64, 68 remain engaged with the patient support apparatus 10. Illustratively, only the patient 13 and the second sheet 68 remain positioned on the patient support apparatus 10.

Figure 16:
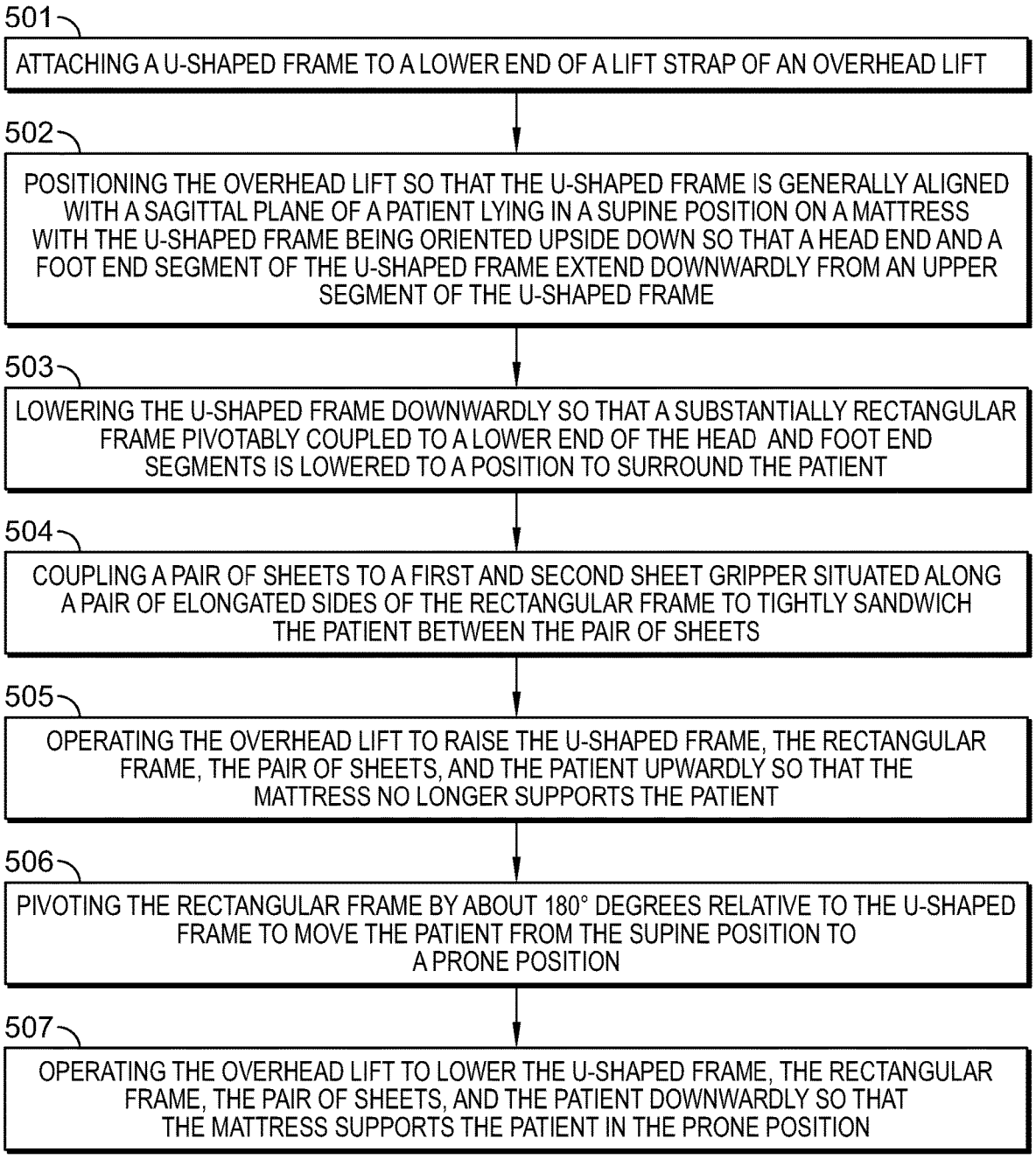
FIG. 16 is a flowchart showing the steps of using the system for turning the patient supported on the patient support apparatus as shown in FIGS. 3-13.

As shown in FIG. 16, the method of turning the patient 13 by at least 180 degrees relative to the axis 22 includes attaching the u-shaped frame 14 to the lower end of the lift strap 17 of a ceiling/overhead lift 26, at step 501. Step 502 includes positioning the overhead lift 26 so that the u-shaped frame 14 is generally aligned with a sagittal plane (as shown in FIG. 2) of the patient 13 lying in a supine position on the mattress 10. Step 502 further includes that the u-shaped frame 14 is oriented upside down so that the first and second segments 30, 32 of the u-shaped frame 14 extend downwardly from the upper segment 20 of the u-shaped frame 14. The caregiver then lowers the u-shaped frame 14 downwardly so that the substantially rectangular frame 16 pivotably coupled to the lower ends 31 of the first and second segments 30, 32 is lowered and positioned to surround the patient 13, at step 503. At step 504, the caregiver couples the sheets 64, 68 to the grippers 45, 47 positioned along the lateral sides of the mattress 10 to tightly sandwich the patient 13 between the sheets 64, 68. The overhead lift 26 is then operated by the caregiver to raise the u-shaped frame 14, the rectangular frame 16, the sheets 64, 68, and the patient 13 located between the sheets 64, 68 upwardly so that the mattress 10 no longer supports the patient 13, at step 505. At step 506, the rectangular frame 16 is pivoted by about 180 degrees relative to the u-shaped frame 14 to move the patient 13 from the supine position to the prone position. The overhead lift 26 is then operated to lower the u-shaped frame 14, the rectangular frame 16, the sheets 64, 68, and the patient 13 downwardly so that the mattress 10 once again supports the patient 13 with the patient being in the prone position, at step 507.

Figure 28:
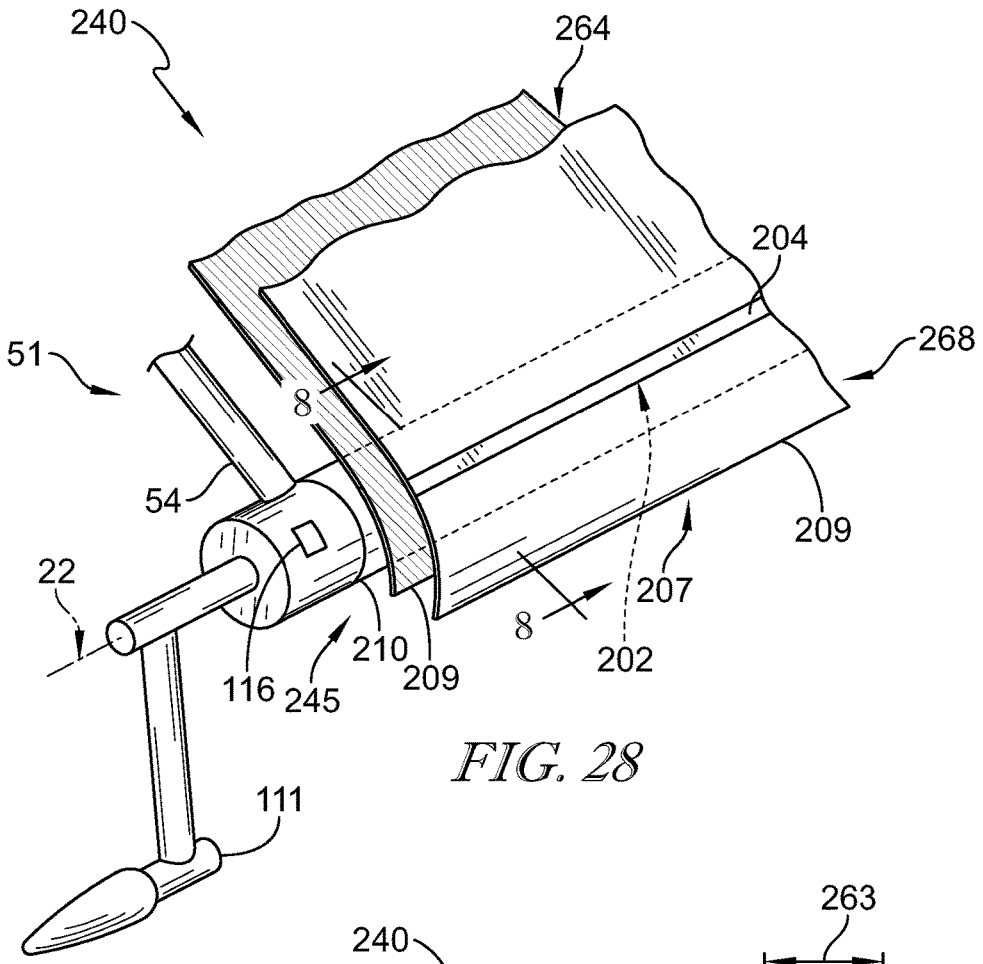
FIG. 28 is a perspective view of a second embodiment of the sheet attachment mechanism showing a gripper formed to include a channel and a wedge positioned within and sized to block removal of the sheets from the channel.
Figure 29:
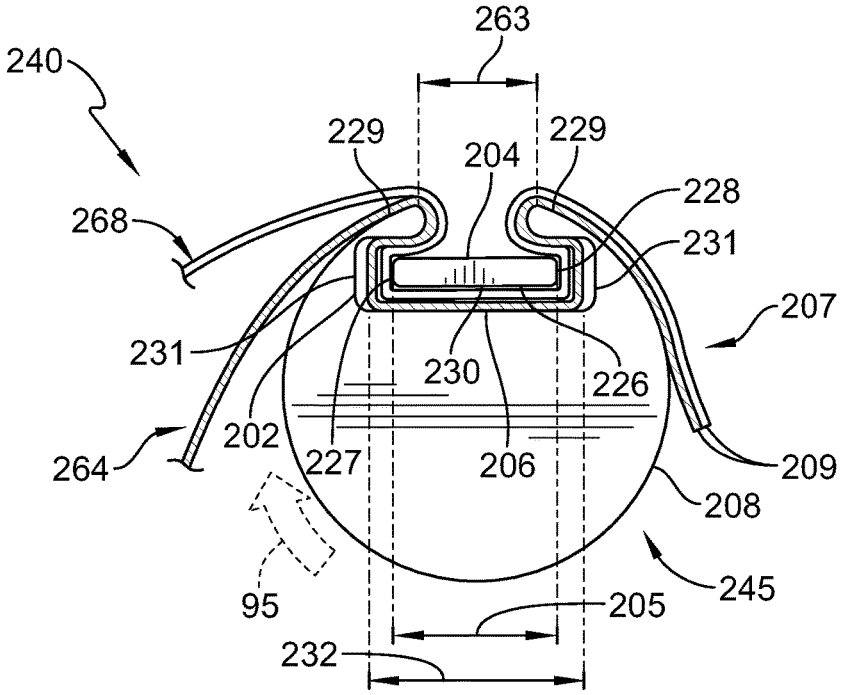
FIG. 29 is a cross-sectional view taken along line 8-8 of FIG. 28 of the second embodiment of the sheet attachment mechanism showing the attachment of the sheets to the gripper via the wedge engaging the sheets within the channel and suggesting that the wedge retains the sheets in a locked position during rotation.

As mentioned above, the sheet attachment mechanism 40 may be formed as additional embodiments as shown in FIGS. 28-31. A second sheet attachment mechanism 240 according to the present disclosure is adapted to removeably couple the sheets 264, 268 to the grippers 245, 247. The second sheet attachment mechanism 240 is shown in FIGS. 28 and 29 of the present disclosure. The second sheet attachment mechanism 240 is similar to the first sheet attachment mechanism 40 shown in FIGS. 26 and 27 and described above. Accordingly, the description of the first sheet attachment mechanism 40 is hereby incorporated by reference to apply to the sheet attachment mechanism 240 except as it departs from the further description and drawings of the sheet attachment mechanism 240.

The second embodiment of the attachment mechanism 240 is formed within the grippers 245, 247 and includes a groove 202 and a wedge 204 sized to fit within the groove 202 and block the sheets 264, 268 from exiting the groove 202 when placed between an upper surface 206 of the groove 202 and the wedge 204. At least one of the grippers 245, 247 is formed to include the groove 202 in an outer surface 208 of the gripper 245, 247 such that it may be accessed by the caregiver. Illustratively, each gripper 245, 247 is formed to include a groove 202 configured to receive the wedge 204 and the sheets 264, 268 simultaneously. The groove 202 extends along the axis 22 between a head end 210 and a foot end (not shown) of each gripper 245, 247 in a substantially straight line. The groove 202 is sized to have an opening 203 smaller than that of a width 205 of the wedge 204 such that the wedge 204 cannot be removed from the groove 202 without manual removal by the caregiver. The wedge 212 is sized to extend along the length of the groove 202 and is configured to be inserted into and removed from the groove 202 such that the caregiver may use the attachment mechanism 240 to removeably couple the sheets 264, 268 to the grippers 245, 247. This creates the pocket 59 between the sheets 264, 268 wherein the patient 13 is located.

As shown in FIG. 29, to removeably couple the sheets 264, 268 to the grippers 245, 247, the caregiver removes the wedge 204 from the groove 202 and places both sheets 264, 268 into the groove 202 simultaneously. The sheets 264, 268 are positioned over the grippers 245, 247 and the groove 202 such that an excess length 207 of sheet 264, 268 extends downwardly from the grippers 245, 247 with the lateral edges 209 of each of the sheets 264, 268 being the portion of each of the sheets 264, 268 farthest away from each of the grippers 245, 247. Illustratively, each excess length 207 of the sheets 264, 268 should measure substantially the same distance between the gripper 245, 247 and the lateral edge 209. Once the sheets 264, 268 are positioned, the caregiver places the wedge 204 into the groove 202 on top of and adjacent to the sheets 264, 268 such that the sheets 264, 268 are located between a bottom surface 226 of the wedge 204 and the upper surface 206 of the groove 202. The caregiver does so by inserting a first end 227 of the wedge 204 into the groove 202 and then manipulating the wedge 204 such that a second end 228 may be inserted into the opposing side of the groove 202. Further, either the first end 227 or the second end 228 may be inserted into the groove 202 first. The wedge 204 has a weight greater than that of the sheets 264, 268 and is, illustratively, made of a flexible material suitable for manipulation as discussed above.

Due to the width 205 of the wedge 204 being greater than the opening 203 of the groove 202, the groove 202 is sized to retain the wedge 204 within the groove 202 with a pair of flanges 229 extending inwardly towards a center 230 of the groove 202. The flanges 229 extend from a pair of side walls 231 forming the groove 202 such that the distance between the flanges 229 forms the opening 203 of the groove 202. The wedge 204 is sized such that it has a width 205 greater than the a width 263 of the opening 203 but smaller than the width 232 of the groove 202. Therefore, the opening 203 is sized to retain the wedge 204 and the sheets 264, 268 within the groove 202 when the wedge 204 is placed into the groove 202 by the caregiver after placing the sheets 264, 268 as discussed above. Once the sheets 264, 268 have been coupled to the grippers 245, 247 by the insertion of the wedge 204 into the groove 202, the grippers 245, 247 are configured to be rotated by the caregiver about the longitudinal axis 22 away from the patient support apparatus 10 in the sheet-tensioning direction 95 to create tension in the sheets 264, 268. The caregiver continues to rotate the grippers 245, 247 until slight tension is created in the sheets 264, 268 such that the sheets 264, 268 are securely, yet removeably coupled to the grippers 245, 247. The sheets 264, 268 are now in position to be further tensed via the sheet tensioning mechanism 42 prior to rotation as discussed above.

Figure 30:
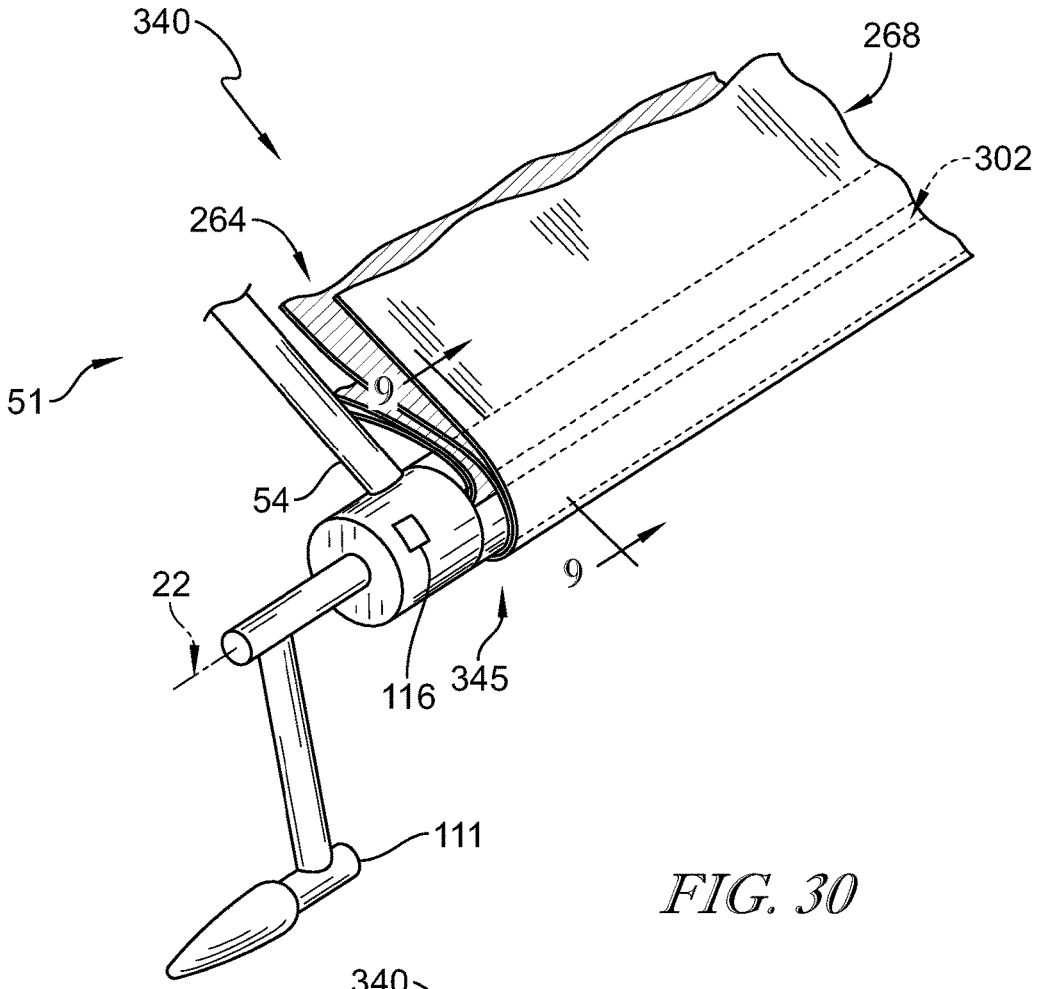
FIG. 30 is a perspective view of a third embodiment of the sheet attachment mechanism showing a gripper formed from at least two gripper segments such that a channel is formed therebetween and suggesting that the sheets are retained in the channel throughout movement of the patient.
Figure 31:
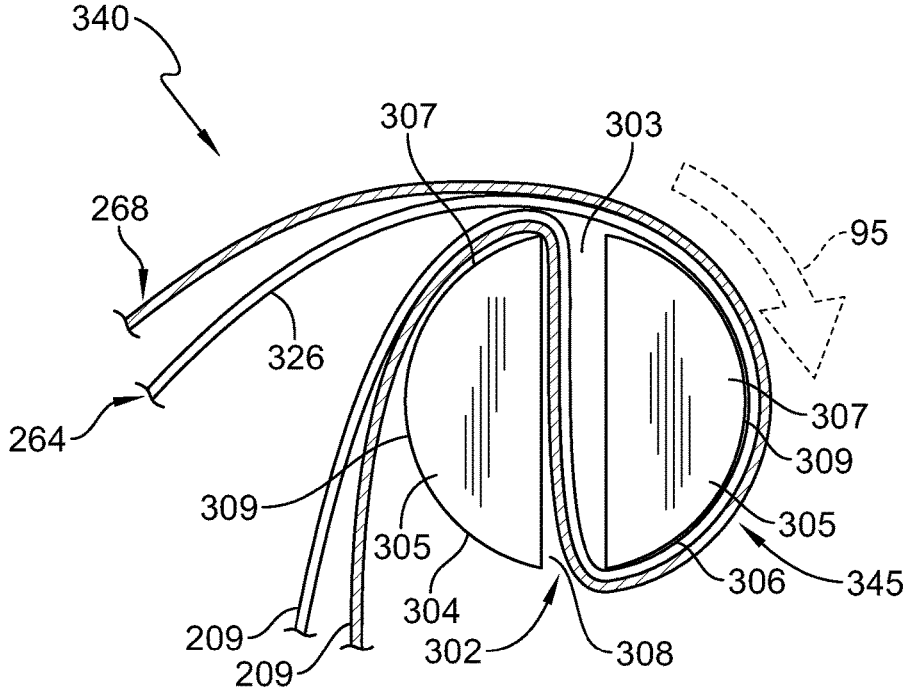
FIG. 31 is a cross-sectional view taken along line 9-9 of FIG. 30 of the third embodiment of the sheet attachment mechanism showing the attachment of the sheets to the gripper and suggesting rotation of the gripper in the sheet-tensioning direction to retain the sheets between the gripper segments.

A third sheet attachment mechanism 340 according to the present disclosure is adapted to removeably couple the sheets 264, 268 to the grippers 345, 347. The third sheet attachment mechanism 340 is shown in FIGS. 30 and 31 of the present disclosure. The third sheet attachment mechanism 340 is similar to the first sheet attachment mechanism 40 described above and shown in FIGS. 26 and 27 and the second attachment mechanism 240 shown in FIGS. 28 and 29 and described above. Accordingly, the description of the first sheet attachment mechanism 40 and the second sheet attachment mechanism 240 is hereby incorporated by reference to apply to the sheet attachment mechanism 340 except as it departs from the further description and drawings of the sheet attachment mechanism 340.

The third embodiment of the attachment mechanism 340 is formed within the grippers 345, 347 and includes a channel 302 extending through the grippers 345, 347 such that each gripper 345, 347 is made from two distinct pieces 304, 306 spaced apart from each other, thereby forming the channel 302 therebetween. Illustratively, both grippers 345, 347 are formed to include the attachment system 340. As shown in FIG. 31, the channel 302 is configured to receive and guide both of the sheets 264, 268 through each of the grippers 345, 347 such that the sheets 264, 268 extend between a channel entrance 308 formed in a lower section 305 of the grippers 345, 347 and a channel exit 303 formed in an upper section 307 of the grippers 345, 347. Illustratively, the sheets 264, 268 wrap around an outer surface 309 of the grippers 345, 347 such that the channel exit 303 and the outer surface 309 of at least one piece 304, 306 of each of the grippers 345, 347 is substantially encompassed by the sheets 264, 268.

To removeably attach the sheets 264, 268, the caregiver places the sheets 264, 268 over the gripper 345, 347 such that a lateral edge 209 of each sheet 264, 268 extends downwardly away from each of the grippers 345, 347 and the lateral edges 209 may be accessed by the caregiver. As such, the sheets 264, 268 are positioned to allow the caregiver to removeably couple the sheets 264, 268 to the grippers 345, 347. The caregiver then guides the lateral edges 209 of the sheets 264, 268 into the channel entrance 308 and threads the sheets 264, 268 substantially upwardly through the channel 302 until reaching the channel exit 303. The channel exit 303 is formed at the opposite end of the channel 302 in relation to the channel entrance 308. The lateral edges 209 of the sheets 264, 268 are further guided through the channel exit 303 such that the lateral edges 209 once again extend downwardly away from each of the grippers 345, 347 but are positioned between the gripper 345, 347 and a body 326 of the first sheet 264. Once the sheets 264, 268 are in thread through the channel 302, the caregiver rotates the grippers 345, 347 away from the patient 13 in the sheet-tensioning direction 95 as shown in FIG. 31. The rotation creates slight tension in the sheets 264, 268 and removeably couples the sheets 264, 268 to the gripper 345, 347. Illustratively, the grippers 345, 347 are configured to create slight tension in the sheets 264, 268 after at least a half turn of the grippers 345, 347 in the sheet-tensioning direction 95. As such, the sheets 264, 268 are removeably coupled to the grippers 345, 347 with slight tension and configured to maintain increased tension provided via the sheet tensioning mechanism 42.

Figure 25:
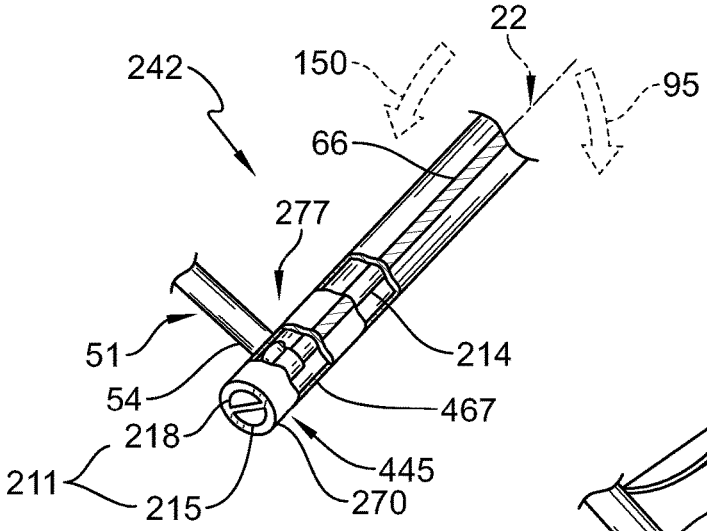
FIG. 25 is a perspective view of a second embodiment of the sheet tensioning mechanism including an electric actuator coupled to an outer facing surface of the housing and a motor located within the housing and showing that the motor is in communication with the gripper such that the gripper rotates in either the sheet-releasing or sheet-tensioning direction in response to actuation of the electric actuator.

As mentioned above, the sheet tensioning mechanism 42 may be formed as an additional embodiment as shown in FIG. 25. A second sheet tensioning mechanism 242 according to the present disclosure is adapted to create additional tension in the sheets 264, 268 to secure the patient 13 in the pocket 59 created between the sheets 264, 268 445, 447. The second sheet tensioning mechanism 242 is shown in FIG. 25 of the present disclosure. The second sheet tensioning mechanism 242 is similar to the first sheet tensioning mechanism 42 described above and shown in FIGS. 21-24. Accordingly, the description of the first sheet tensioning mechanism 42 is hereby incorporated by reference to apply to the second sheet tensioning mechanism 242 except as it departs from the further description and drawings of the second sheet tensioning mechanism 242.

The second embodiment of the sheet tensioning mechanism 242 is formed within the grippers 445, 447. The sheet tensioning mechanism 242 includes a sheet-tensioning mechanism housing 270 and a motor assembly 277. The sheet-tensioning mechanism housing 270 is formed to house a majority of the motor assembly 277 and is illustratively positioned at the lower end 467 of each of the grippers 445, 447 such that each gripper 445, 447 is configured to rotate independently of the other. The motor assembly 277 is positioned within the housing 270 and configured to act as a means to rotate the respective gripper 445, 447 and thereby rotate the sheets 64, 68 removeably coupled to the grippers 445, 447. As shown in FIG. 25, the housing 270 is substantial similar to that discussed above in relation the sheet tensioning mechanism 42. As such, the housing 270 includes an actuator 211 extending through an opening 213 and the housing 270. Illustratively, the actuator 211 is formed as a plurality of buttons 211. To electrically/mechanically create tension in the sheets 64, 68, the caregiver actuates the tensioning button 211 thereby actuating the motor assembly 277.

The motor assembly 277 selectively controls the rotation of the grippers 445, 447 relative to the longitudinal axis 22. The motor assembly 277 is configured to move between a tensioning state and a releasing state. When in the tensioning state, the assembly 277 rotates the gripper 445, 447 in a sheet-tensioning direction 95, as shown in FIG. 25. When in the releasing state, the assembly 277 rotates one of the grippers 445, 447 in a sheet-releasing direction 150. Illustratively, the sheet-releasing direction 150 is the direction opposite the sheet-tensioning direction 95 as shown in FIG. 25. The motor assembly 277 may be moved between the tensioning state and the releasing state via the plurality of buttons 211. Illustratively, the plurality of buttons includes a tensioning button 218 configured to move the assembly 277 to a tensioning state and a releasing button 215 configured to move the assembly 277 to a releasing state.

The buttons 215, 218 actuate a motor 217 coupled to a rotation rod 214. The rotation rod 214 is sized to extend the length of the grippers 445, 447 and is coupled to the grippers 445, 447 to translate the rotation of the motor 217 to the 445, 447. Upon actuation of the tensioning button 218, the motor 217 is configured to rotate the rod 214 in the sheet-tensioning direction 95 away from the patient 13. Once rotation of the grippers 445, 447 in the sheet-tensioning direction 95 is complete and the sheets 64, 68 have increased tension and are secured between the grippers 445, 447, the motor 217 is configured to stop rotation by applying a braking mechanism (not shown) upon itself thereby halting rotation of the grippers 445, 447. Further to release the sheets 64, 68, actuation of the releasing button 215 is configured to rotate the rod 214 in the sheet-releasing direction until the sheets 64, 68 are free to be removed from the grippers 445, 447 and have decreased tension. The motor 217 may again apply a braking mechanism upon itself based upon preprogramed algorithms such that the motor 217 automatically stops once the tension in the sheets 64, 68 is released. The motor 217 may further be manually controlled by the caregiver via the buttons 211.

As mentioned above, the rotation mechanism 38 may be formed as additional embodiments as shown in FIGS. 19 and 20. A second rotation mechanism 238 according to the present disclosure is adapted to rotate the patient 13 about the longitudinal axis 22 to move the patient 13 between a supine position and a prone position. The second rotation mechanism 238 is shown in FIG. 19 of the present disclosure. The second rotation mechanism 238 is similar to the first rotation mechanism 38 described above and shown in FIG. 18. Accordingly, the description of the first rotation mechanism 38 is hereby incorporated by reference to apply to the second rotation mechanism 238 except as it departs from the further description and drawings of the second rotation mechanism 238.

As illustrated in FIG. 19, the second embodiment the rotation mechanism 238 further includes a rotation damper 248 positioned between and coupled to an inner surface 284 of an anchor body 278 of a rotation anchor 250 and an inner surface 281 of a rotation anchor receiver 260. The rotation anchor 250 and rotation anchor receiver 260 are similar to those discussed above in relation to the first embodiment of the rotation mechanism 38. The second embodiment of the rotation mechanism 238 differs from the first 38 in view of the addition of the rotation damper 248. First, the anchor body 278 is formed to include a first flange 280 extending from the anchor body 278 at a top section 290 of the body 278 and a second flange 282 extending from the anchor body 278 at a bottom section 283 of the body 278. The rotation anchor receiver 260 is similarly modified to include a first flange 287 extending from a top section 289 of the receiver 260 and a second flange 292 extending from a bottom section 296 of the receiver 260. The damper 248 is formed to encompass at least half of an outer surface 293 of the anchor extension 279 such that the anchor extension 279 extends through a mid-point 295 of the damper 248. With the addition of a width 297 of the damper 248 to a total width 285 of the rotation mechanism 238 that the anchor extension 279 is sized to a length 299 greater than the length 297 of the damper 248 and the length 96 of the anchor extension 79 of the first embodiment. Similar to the first embodiment 38, the extension 279 is formed to include the anchor retainer 81 at an outer end 291 of the extension 279. As such, the rotation anchor body 278 is configured to remain at a substantially consistent position along the axis 22 throughout rotation of the patient 13.

A third rotation mechanism 338 according to the present disclosure is adapted to rotate the patient 13 about the longitudinal axis 22 to move the patient 13 between a supine position and a prone position. The third rotation mechanism 338 is shown in FIG. 20 of the present disclosure. The third rotation mechanism 338 is similar to the first rotation mechanism 38 described above and shown in FIG. 18 and the second rotation mechanism 238 shown in FIG. 19 and described above. Accordingly, the description of the first rotation mechanism 38 and the second rotation mechanism 238 is hereby incorporated by reference to apply to the third rotation mechanism 338 except as it departs from the further description and drawings of the third rotation mechanism 338.

The third embodiment of the rotation mechanism 338 is configured to rotate in response to an electronic command in response to an actuation by the caregiver. The rotation mechanism 338 further includes a motor system 310 positioned between and coupled to a rotation anchor 312 and a rotation anchor receiver 314. The rotation anchor receiver 314 is coupled to the u-shaped frame 14 and remains in substantially the same location throughout the rotation of the patient 13. The rotation anchor 312 is coupled to the head and foot end frames 49, 51 of the rectangular frame 16 and is configured to move with the rectangular frame 16 upon rotation of the patient 13 about the axis 22. This allows for the rotation anchor receiver 314 to maintain the position and stability of the patient 13 positioned between the sheets 64, 68 while the rotation anchor 312 rotates along the axis 22 in response to actuation of the motor system 310.

Actuation of the motor system 310 occurs when the caregiver applies an actuator force upon the actuator 358. The actuator 358 may be shaped as a button. Illustratively, the actuator 358 is formed to include two buttons 358, and the buttons 358 are configured to actuate and/or halt the rotation of the patient 13 about the longitudinal axis 22. Each button 358 may actuate and/or halt the motor system 310 independently of other button 358 such that one button 358 may be configured to rotate the patient 13 clockwise about the longitudinal axis 22, the other button 358 may be configured to rotate the patient counter-clockwise about the longitudinal axis 22, and an additional button 358 may be configured to halt rotation of the patient 13. In response to actuation of the buttons 358, the motor system 310 is configured to rotate and such that the rotational movement is translated to the rotation anchor 312 such that the rotation anchor 312 begins to rotate. The anchor 312 is formed to include an anchor body 318 positioned adjacent to the motor system 310 and the anchor receiver 314 and an anchor extension 316 formed to extend from the anchor body 318 inwardly towards the receiver 314.

Further, the rotation anchor receiver 314 is formed to include a first flange 380 extending from the anchor receiver 314 at a top portion 381 of the anchor receiver 314 and a second flange 382 extending from the anchor receiver 314 at a bottom portion 383 of the receiver 314. The motor system 310 is formed to encompass at least half of an outer surface 393 of the anchor extension 379 such that the anchor extension 379 extends through a mid-point 395 of the motor system 310. With the addition of a width 397 of the motor system 310 to a total width 385 of the rotation mechanism 346 that the anchor extension 379 is sized to a length 399 greater than the width 397 of the motor system 310 and the length 96 of the anchor extension 79 of the first embodiment. Differing from the previous embodiments 38, 238, the extension 379 does not include an anchor retainer as no retainer is necessary due to the positioning of the anchor body 318 and the ability of the body 318 to rotate with the rectangular frame 16 in response to rotation of the patient 13. As such, upon actuation of the motor system 310, the anchor extension 316 is rotated about the axis 22 thereby translating such rotation to the anchor body 318 coupled to the head and foot end frames 49, 51 of the rectangular frame 16. Illustratively, the actuators 358 are configured to stop rotational movement of the patient 13 at any point throughout the range of rotation of the patient 13. The patient's range of rotation includes the entire turn radius of the patient 13 such that the patient 13 may be positioned at any angle about the axis 22 as shown in FIGS. 10 and 11.

Although this disclosure refers to specific embodiments, it will be understood by those skilled in the art that various changes in form and detail may be made without departing from the subject matter set forth in the accompanying claims.

The invention claimed is:

1. A patient turning apparatus for turning a patient by 180 degrees relative to a mattress of a bed supporting the patient, the patient being situated between a pair of sheets, and for use with a ceiling supported overhead lift having a motor that operates to extend and retract a lifting strap that extends from the overhead lift, the patient turning apparatus comprising a U-shaped frame having an elongated, horizontally oriented, upper segment, a first segment extending generally vertically downwardly from a head end of the upper segment, a second segment extending generally vertically downwardly from a foot end of the upper segment, and a coupler situated at a middle region of the upper segment and configured to attach to a lower end of the lift strap of the overhead lift, and a rectangular frame separate from the U-shaped frame having elongated first and second sheet grippers at the sides of the rectangular frame, a head end frame member at a head end of the rectangular frame, and a foot end frame member at a foot end of the rectangular frame, wherein middle regions of the head end frame member and the foot end frame member are pivotably coupled to lower ends of the first and second segments, respectively, of the U-shaped frame so that the rectangular frame is rotatable about a longitudinally extending pivot axis relative to the U-shaped frame, wherein the rectangular frame is sized to surround the patient when the rectangular frame is resting upon the mattress, wherein the pair of sheets is coupled to each of the first and second sheet grippers to tightly sandwich the patient between the pair of sheets to permit the rectangular frame and the patient to be rotated by 180 degrees relative to the U-shaped frame after the strap is retracted by the overhead lift to raise: the U-shaped frame, the rectangular frame, and the patient upwardly away from the mattress by a sufficient distance to provide clearance between the rotating rectangular frame and the mattress.

2. The patient turning apparatus of claim 1, further comprising at least one rotation mechanism coupled to the first segment of the U-shaped frame at an upper surface of the rotation mechanism and further coupled to the head end frame member at a pair of opposing lateral sides.

3. The patient turning apparatus of claim 2, wherein the rotation mechanism is configured to move between an unlocked state and a locked state by actuation of a rotation lock mechanism moveably coupled to the first segment and configured to engage the rotation mechanism and block rotation of the rotation mechanism when the rotation mechanism is in the locked state.

4. The patient turning apparatus of claim 2, wherein the rotation mechanism includes an anchor and an anchor receiver, the anchor is formed to include a body and an extension extending away the body through the anchor receiver, the anchor receiver is formed to include an aperture pivotably engaging the extension, the extension is sized to terminate in an anchor retainer having a greater height than the aperture formed in the anchor receiver.

5. The patient turning apparatus of claim 4, wherein the rotation mechanism further includes a damper positioned between the body of the anchor and the anchor receiver, the rotation mechanism is configured to decrease the speed of rotation of the patient around the axis.

6. The patient turning apparatus of claim 5, further comprising a rotation locking mechanism coupled to the body of the anchor and sized to extend a length of the anchor receiver and removeably couples to a top section of the anchor receiver.

7. The patient turning apparatus of claim 1, wherein the patient turning apparatus further comprises a sheet attachment mechanism coupled to an outer surface of the first gripper and the second gripper configured to removeably couple the sheets to the sheet grippers.

8. The patient turning apparatus of claim 7, wherein the sheet attachment mechanism includes a plurality of gripper strips coupled to the outer surface of the first gripper and the second gripper and a plurality of sheet strips coupled to a bottom surface of the sheets at a pair of lateral edges of each of the sheets, the sheet strips are configured to removeably couple to the gripper strips.

9. The patient turning apparatus of claim 8, wherein the gripper strips and the sheet strips are sized to extend a length of the grippers from an upper end of the grippers to the lower end of the grippers, the sheet strips and gripper strips are further sized to have a same width such that the sheet strips are configured to be positioned to be directly on top of the gripper strips.

10. The patient turning apparatus of claim 1, further comprising a sheet tensioning mechanism coupled to the sheet grippers at a lower end of each gripper and configured to rotate the sheet grippers about the axis in both a sheet-tensioning direction and a sheet-releasing direction.

11. The patient turning apparatus of claim 10, wherein the sheet tensioning mechanism includes a housing coupled to the lower end of each of the grippers and a ratchet assembly located within the housing such that each gripper is configured to rotate independently of the opposite gripper.

12. The patient turning apparatus of claim 11, wherein the sheet tensioning mechanism includes a sheet-tensioning mechanism housing coupled to a pair of lower ends of the grippers and a pair of ratchet assemblies coupled to an configured to rotate the grippers, a majority of the ratchet assemblies is located within the sheet-tensioning mechanism housing such that each gripper is configured to rotate independently of the other.

13. The patient turning apparatus of claim 12, wherein the ratchet assembly includes a gear in communication configured to be rotated about the axis and a ratchet release mechanism configured to engage the gear and control rotation of the grippers.

14. A method of turning a patient by 180 degrees relative to a mattress of a bed supporting the patient, the method comprising attaching a U-shaped frame to a lower end of a lift strap of a ceiling supported overhead lift, such that the overhead lift is positioned so that the U-shaped frame is generally aligned with a sagittal plane of the patient lying in a supine position on the mattress with the U-shaped frame being oriented upside down so that head end and foot end segments of the U-shaped frame extend downwardly from an upper segment of the U-shaped frame, lowering the U-shaped frame downwardly so that a substantially rectangular frame which is separate from the U-shaped frame is pivotably coupled to lower ends of the head end and foot end segments is lowered to a position to surround the patient, coupling a pair of sheets to first and second sheet grippers situated along elongated sides of the substantially rectangular frame to tightly sandwich the patient between the pair of sheets, operating the overhead lift by retracting the strap to raise: the U-shaped frame, the substantially rectangular frame, the pair of sheets, and the patient upwardly so that the mattress no longer supports the patient, pivoting the substantially rectangular frame by about 180 degrees relative to the U-shaped frame to move the patient from the supine position to a prone position, and operating the overhead lift by extending the strap to lower: the U-shaped frame, the substantially rectangular frame, the pair of sheets, and the patient downwardly so that the mattress once again supports the patient with the patient being in the prone position.

15. The method of claim 14, the method further comprising uncoupling the pair of sheets from the first and second grippers after rotating the substantially rectangular frame by about 180 degrees and lowering the overhead lift.

16. The method of claim 14, the method further comprising actuating a rotation locking mechanism such that the rotation locking mechanism is placed in an unlocked position, allowing for the pivoting of the substantially rectangular frame.

17. The method of claim 15, wherein uncoupling the pair of sheets from the first and second grippers after rotating the substantially rectangular frame by about 180 degrees and lowering the overhead lift comprises actuating a ratchet release of the sheet tensioning mechanism formed in an outer surface of the first and second grippers, removing the pair of sheets from engagement with the first and second sheet grippers to release the patient from between the pair of sheets, operating the overhead lift to raise the U-shaped frame and the substantially rectangular frame upwardly so that the mattress no longer supports the substantially rectangular frame, and detaching the U-shaped frame from the lower end of the lift strap of the overhead lift such that the U-shaped frame and the substantially rectangular frame are uncoupled from the overhead lift and configured to be coupled to a second overhead lift located in a second patient room.

18. The method of claim 17, wherein actuating the ratchet release comprises moving the ratchet release out of engagement with a biasing member coupled to a pawl, thereby permitting rotation of the first and second grippers about a rotation axis in a sheet-tensioning direction and a sheet-releasing direction.

19. The method of claim 17, wherein removing the pair of sheets from engagement with the first and second grippers to release the patient from between the pair of sheets comprises rotating the first and second grippers about a rotation axis in a sheet-releasing direction until a furthermost lateral edge of a second sheet is positioned such that it may be accessed by a caregiver and moving the ratchet release into engagement with a biasing member coupled to a pawl to block rotation of the first and second grippers in the sheet-releasing direction about the rotation axis.

20. The method of claim 19, wherein removing the pair of sheets from engagement with the first and second grippers to release the patient from between the pair of sheets comprises gripping the furthermost lateral edge of the second sheet, uncoupling the second sheet from the first and second grippers by pulling the second sheet away from the first and second grippers thereby exposing a first sheet coupled to the first and second grippers, gripping a furthermost lateral edge of the first sheet, and uncoupling the first sheet from the first and second grippers by pulling the first sheet away from the first and second grippers.

* * * * *